US010683682B2

(12) United States Patent
Taurasi et al.

(10) Patent No.: US 10,683,682 B2
(45) Date of Patent: Jun. 16, 2020

(54) CLOSURE LATCH FOR VEHICLE DOOR HAVING DOUBLE PULL RELEASE MECHANISM DRIVEN BY CHILD LOCK ACTUATOR

(71) Applicant: Magna Closures Inc., Newmarket (CA)

(72) Inventors: Marco Taurasi, Leghorn (IT); Francesco Cumbo, Pisa (IT)

(73) Assignee: MAGNA CLOSURES INC., New Market, Ontario (CA)

( * ) Notice: Subject to any disclaimer, the term of this patent is extended or adjusted under 35 U.S.C. 154(b) by 406 days.

(21) Appl. No.: 15/581,881

(22) Filed: Apr. 28, 2017

(65) Prior Publication Data

US 2017/0314297 A1 Nov. 2, 2017

Related U.S. Application Data

(60) Provisional application No. 62/330,645, filed on May 2, 2016.

(51) Int. Cl.

| | |
|---|---|
| ***E05B 77/22*** | (2014.01) |
| ***E05B 81/06*** | (2014.01) |
| ***E05B 81/16*** | (2014.01) |
| ***E05B 83/36*** | (2014.01) |

(52) U.S. Cl.

CPC ..... *E05B 77/22* (2013.01); *E05B 81/06* (2013.01); *E05B 81/16* (2013.01); *E05B 83/36* (2013.01)

(58) Field of Classification Search

CPC ..... E05B 81/06; E05B 81/16; E05B 83/36; E05B 77/24; E05B 77/245; E05B 77/26; E05B 77/265; E05B 81/20; E05B 77/22

USPC ..... 292/2

See application file for complete search history.

(56) References Cited

U.S. PATENT DOCUMENTS

| | | | | |
|---|---|---|---|---|
| 8,141,916 | B2 * | 3/2012 | Tomaszewski | E05B 77/26 292/201 |
| 8,474,888 | B2 * | 7/2013 | Tomaszewski | E05B 77/26 292/201 |
| 2006/0131893 | A1 * | 6/2006 | Tomaszewski | E05B 81/06 292/216 |
| 2008/0203737 | A1 * | 8/2008 | Tomaszewski | E05B 77/26 292/216 |
| 2008/0224482 | A1 * | 9/2008 | Cumbo | E05B 77/02 292/216 |
| 2016/0017645 | A1 * | 1/2016 | Tomaszewski | E05B 77/26 292/240 |

* cited by examiner

*Primary Examiner* — Nathan Cumar
(74) *Attorney, Agent, or Firm* — Dickinson Wright PLLC

(57) ABSTRACT

The present disclosure relates to a closure latch for a vehicle door, and more particularly to a closure latch for a vehicle door equipped with a passive entry feature. To this end, the present disclosure relates to the use of a power child lock actuator to manage the double pull function of the closure latch.

15 Claims, 17 Drawing Sheets

CLOSURE LATCH FOR VEHICLE DOOR HAVING DOUBLE PULL RELEASE MECHANISM DRIVEN BY CHILD LOCK ACTUATOR

CROSS-REFERENCE TO RELATED APPLICATIONS

This application claims the benefit of U.S. Provisional Application No. 62/330,645 filed May 2, 2016. The entire disclosure of the above application is incorporated herein by reference.

FIELD

The present disclosure relates generally to closure latches for a vehicle passenger door. More particularly, the present disclosure is directed to a closure latch equipped with a power release actuator and a power child lock actuator configured to manage a double pull manual inside release function.

BACKGROUND

This section provides background information related to closure latches and is not necessarily prior art to the closure latch of the present disclosure.

Passive entry systems for vehicles are provided on some vehicles to permit a vehicle user who is in possession of the key fob to simply pull the door handle and open the door without the need to introduce a key into a keyhole in the door. The key fob is typically equipped with an electronic device that communicates with the vehicle's on-board control system to authenticate the user. When the user pulls the outside door handle to indicate that he/she wishes entry into the vehicle, an electric actuator associated with a door-mounted closure latch is actuated to release a latch mechanism so as to unlatch the door and permit subsequent movement of the door to its open position. The outside door handle may also be equipped with a switch that triggers the electric actuator. The latch mechanism may also be mechanically released from inside the vehicle since the inside door handle is connected to an inside release mechanism associated with the closure latch. In some jurisdictions, however, there are regulations that govern the degree of connection provided by the inside release mechanism between the inside door handle and the latch mechanism (particularly for a rear door, where children may be the occupants).

Many modern closure latches provide various power-operated features including power release, power lock and power child lock in addition to a double pull inside release function. However, integration of such a double pull inside release function into most closure latches requires the addition of a supplemental power-operated actuator or requires complex arrangements using the power release actuator. While commercially-available closure latches are satisfactory to meet operational and regulatory requirements, a need still exists to advance the technology to provide closure latches having reduced complexity and packaging while providing the desired power-operated features and the double pull inside release function previously mentioned. One specific need relates to utilizing an existing power-operated actuator, such as a power child lock actuator, to manage the double pull inside release function.

SUMMARY

This section provides a general summary of the disclosure and is not intended to be considered as a comprehensive and exhaustive listing of its full scope or all of its aspects, features and objectives.

It is an aspect of the present disclosure to provide a closure latch for a vehicle door having a latch mechanism, a latch release mechanism, a power release mechanism for controlling powered actuation of the latch release mechanism, an inside release mechanism, a double pull actuator mechanism operably associated with the inside release mechanism, and a power child lock mechanism for controlling a double pull inside release function.

In accordance with these and other aspects, the present disclosure is directed to a closure latch for a vehicle door. The closure latch comprises: a latch mechanism including a ratchet and a pawl, the ratchet being moveable between a striker capture position and a striker release position, the pawl being moveable between a ratchet holding position whereat the pawl holds the ratchet in its striker capture position and a ratchet releasing position whereat the pawl permits the ratchet to move to its striker release position; a power release mechanism having an actuator lever operatively connected to the pawl and a power release actuator, the actuator lever being moveable between a non-actuated position whereat the pawl is maintained in its ratchet holding position and an actuated position whereat the actuator lever moves the pawl to its ratchet releasing position the power release actuator being operable to move the actuator lever from its home position to its actuated position; an inside release mechanism including an inside release lever, an auxiliary release lever and a lever link, the inside release lever being moveable between a home position and an actuated position in response to actuation of an inside door handle, the auxiliary release lever being moveable between a home position whereat the actuator lever is maintained in its non-actuated position and an actuator lever release position whereat the auxiliary release lever moves the actuator lever to its actuated position, the link lever being moveable between a disengaged position whereat the inside release lever is disconnected from the auxiliary release lever and an engaged position whereat the link lever operatively couples the inside release lever to the auxiliary release lever such that movement of the insider release lever between its home and actuated positions results in concurrent movement of the auxiliary release lever between its home and actuator lever release positions; a double pull actuation mechanism including a double pull lever and a double pull sector, the double pull lever being operatively coupled to the link lever and moveable between a double pull-ON position whereat the double pull lever holds the link lever in its disengaged position and a double pull-OFF position whereat the double pull lever moves the link lever to its engaged position, the double pull sector being moveable between a double lock ON position whereat the double pull sector holds the double pull lever in its double pull-ON position and a double lock OFF position whereat the double pull sector permits the double pull lever to move to its double pull-OFF position, wherein movement of the inside release lever from its home position to its actuated position causes movement of the double pull sector from its double lock ON position to its double lock OFF position; and a power child lock mechanism having a child lock sector and a power lock actuator, the child lock sector being moveable between three distinct sector positions including a first sector position whereat the child lock sector holds the double pull sector in its double lock ON position, a second sector position whereat the double pull sector is located in its double lock OFF position, and a third sector position whereat the child lock sector holds the double pull lever in its double pull-ON position, the power lock actuator being operable to rotate the child lock sector.

The closure latch of the present disclosure is further configured with the inside release lever having an elongated guide slot, the link lever having a guide post disposed in the guide slot for movement of the link lever between its disengaged and engaged positions relative to the inside release lever, and the auxiliary release lever having a bypass cavity and a drive lug. The guide post is aligned with the bypass cavity when the link lever is located in its disengaged position and the guide post is aligned with the drive lug when the link lever is located in its engaged position.

The closure latch of the present disclosure is further configured such that the power release actuator includes a power release motor operable for rotating a power release gear between a home position and a released position. Rotation of the power release gear in a releasing direction from its home position to its released position causes a release cam fixed to the power release gear to move the actuator lever from its non-actuated position to its actuated position.

The closure latch of the present disclosure is further configured with the double pull sector having a first lug adapted to engage and hold the double pull lever in its double pull-ON position when the double pull sector is located in its double lock ON position, and a second lug adapted to engage a drive lug formed on the inside release lever. As such, movement of the inside release lever to its actuated position causes the drive lug to engage the second lug and cause rotation of the double pull sector to its double lock OFF position. The double pull sector further includes a third lug in engagement with the child lock sector for rotating the child lock sector from its first sector position to its second sector position in response to movement of the double pull sector from its double lock ON position to its double lock OFF position. Actuation of the power lock actuator for rotating the child lock sector from its second sector position to its first sector position causes the child lock sector to engage the third lug and rotate the double pull sector from its double lock OFF position to its double lock ON position. In addition, rotation of the child lock sector from either of its first and second sector positions to its third sector position results in a lock lug formed on the child lock sector engaging and holding the double pull lever in its double pull-ON position for establishing the power child locked mode.

The closure latch of the present disclosure provides a double pull inside release function. A first pull on the inside door handle causes movement of the inside release lever to its actuated condition with the link lever located in its disengaged position such that the auxiliary release lever is maintained in its home position. Such first pull movement of the inside release lever to its actuated position causes the double pull sector to move to its double lock OFF position. Upon return of the inside release lever to its home position following completion of the first pull, the double pull lever moves to its double pull-OFF position and the link lever moves to its engaged position. A subsequent second pull of the inside door handle causes the inside door release lever to move to its actuated position which drives the auxiliary release lever to its actuator lever release position for completing the double pull inside release function.

Further areas of applicability will become apparent from the description provided herein. The description and specific embodiments listed in this summary are for purposes of illustration only and are not intended to limit the scope of the present disclosure.

BRIEF DESCRIPTION OF THE DRAWINGS

The drawings described herein have been provided to illustrate selected embodiments and specific features thereof and are not intended to limit the scope of the present disclosure. The present disclosure will now be described by way of example only with reference to the attached drawings, in which.

DETAILED DESCRIPTION

Example embodiments of a closure latch for use in motor vehicle door closure systems are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
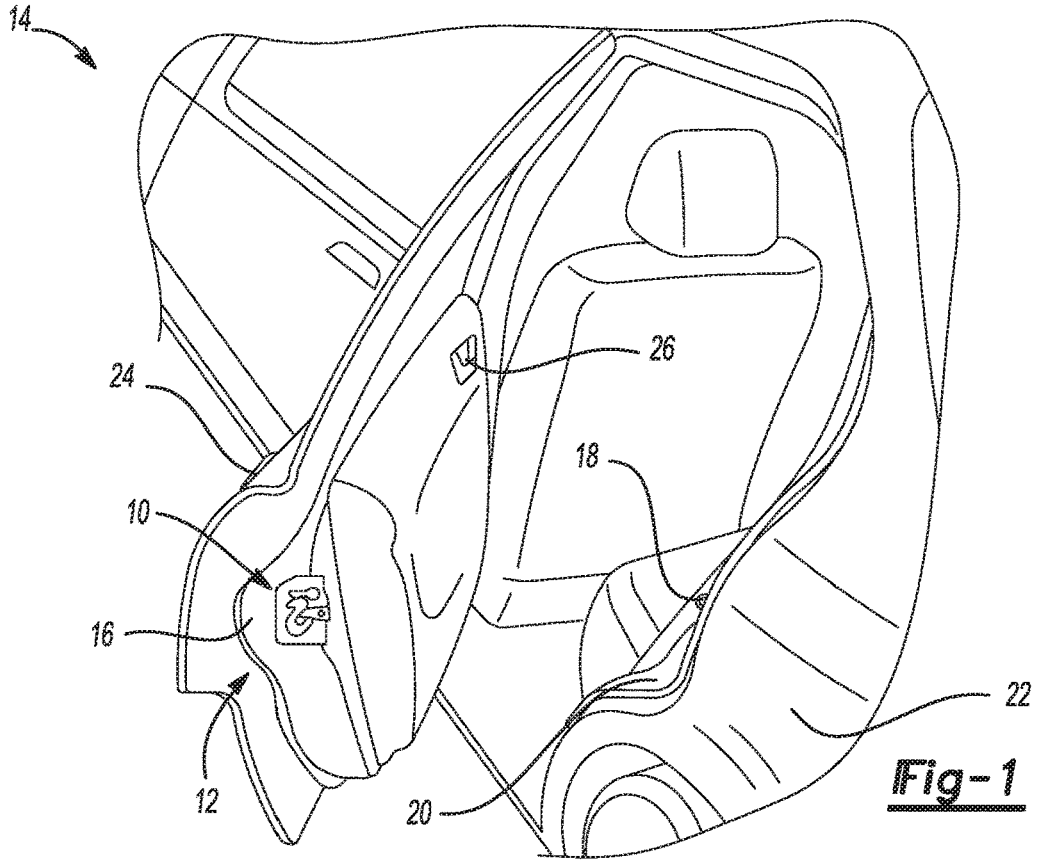
FIG. 1 is a perspective view of a motor vehicle with a rear passenger door that is equipped with a closure latch embodying the teaching of the present disclosure.

Referring initially to FIG. 1, a closure latch 10 for a passenger door 12 of a motor vehicle 14 is shown positioned along a rear edge portion 16 of door 12 and is configured to releaseably engage a striker 18 secured in a door opening 20 formed in the vehicle's body 22 in response to movement of door 12 from an open position (shown) to a closed position. Door 12 includes an external or outside door handle 24 and an internal or inside door handle 26, both of which are operatively coupled (i.e. electrically and/or mechanically) to closure latch 10.

Figure 2:
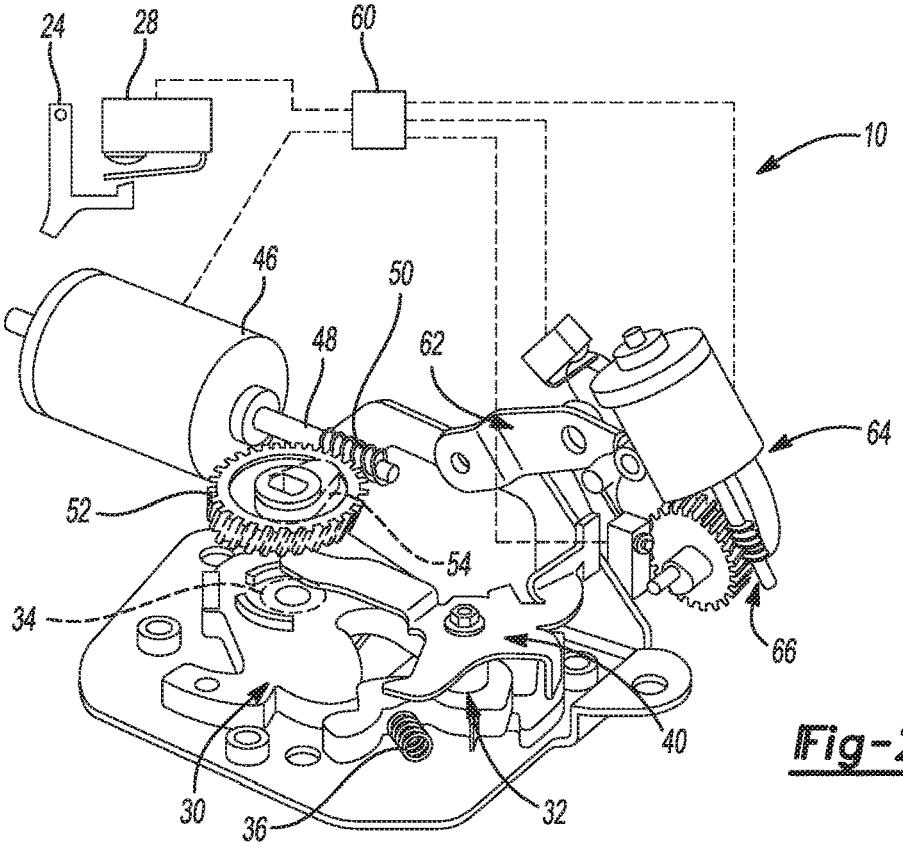
FIG. 2 is an isometric view of a closure latch providing support for the components of a latch mechanism associated with the following disclosure.

Referring now to FIG. 2, a first non-limiting embodiment of closure latch assembly 10 is shown to generally include a latch mechanism, a latch release mechanism, a power release mechanism, an inside door release mechanism, and a power lock mechanism. The latch mechanism includes a ratchet 30 and a pawl 32. Ratchet 30 is moveable between a first or "striker capture" position whereat the ratchet 30 retains the striker 18 and a second or "striker release" position whereat the ratchet 30 permits release of the striker 18. A ratchet biasing member, such as a torsion spring 34, biases ratchet 30 toward its striker release position. The pawl 32 is pivotably moveable relative to ratchet 30 between a first or "ratchet holding" position whereat the pawl 32 holds the ratchet 30 in its striker capture and a second or "ratchet releasing" position whereat the pawl 32 permits the ratchet 30 to move to its striker release position. A pawl biasing member, such as a coil spring 36, biases pawl 32 toward its ratchet holding position.

The latch release mechanism includes, among other things, a pawl release lever 40 operatively connected to pawl 32 and which is movable between a first or "pawl release" position whereat the pawl release lever 40 causes the pawl 32 to move to the ratchet releasing position and a second or "home" position whereat pawl release lever 40 permits pawl 32 to be maintained in the ratchet holding position. A pawl release lever biasing member, such as a suitable pawl release lever spring 42, is provided to bias pawl release lever 40 to its home position. Pawl release lever 40 may be moved from its home position to its pawl release position by several components such as, for example, the power release mechanism and the inside door release mechanism.

The power release mechanism includes, among other things, a power release motor 46 having a rotatable motor output shaft 48, a power release worm gear 50 secured to the motor output shaft 48, a power release (PR) gear 52, and a power release (PR) cam 54. PR cam 54 is connected for common rotation with PR gear 52 and is rotatable between a first or "pawl release" range of positions and a second or "pawl non-release" range of positions. PR gear 52 is driven by worm gear 50 and in turn drives PR cam 54 which controls the pivoting movement of pawl release lever 40 between its home and pawl release positions.

The power release mechanism may be used as part of a passive entry feature. When a person approaches vehicle 14 with an electronic key fob and opens outside door handle 24, an electronic latch release system associated with vehicle 14 senses both the presence of the key fob and that outside door handle 24 has been actuated (e.g. via communication between a switch 28 and an electronic control unit (ECU) shown at 60 that at least partially controls the operation of closure latch 10). In turn, ECU 60 actuates the power release mechanism to release the latch mechanism and unlatch closure latch 10 so as to open the vehicle door.

The power lock mechanism controls the operative connection between an inside release lever 62 associated with the inside door release mechanism and pawl release lever 40. The power lock mechanism includes, among other things, a power lock actuator 64 and a lock mechanism 66.

Figure 3:
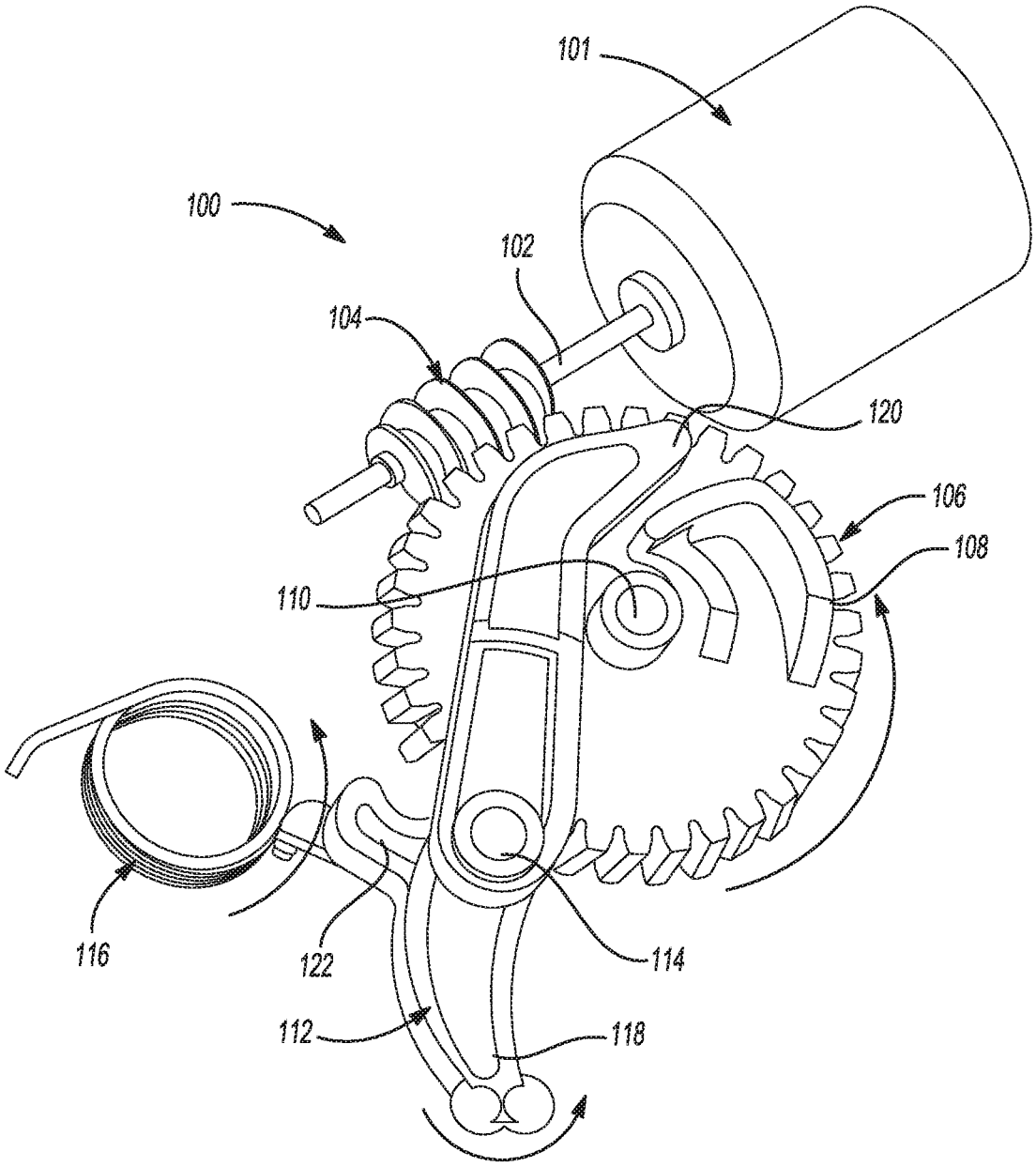
FIG. 3 is an isometric view showing the components of a power release actuator associated with the closure latch of the present disclosure.

Referring now to FIG. 3, the components associated with a non-limiting embodiment of a power release mechanism 100 adapted for use with closure latch 10 are shown to include a power release actuator having a power release motor 101 with a motor shaft 102 driving a worm gear 104, and a power release gear 106 having a release cam 108 formed thereon. Power release gear 106 is rotatable about a post 110 in a first or "releasing" (i.e. counterclockwise) direction and a second or "resetting" (i.e. clockwise) direction via actuation of power release motor 101. Power release gear 106 is rotatable about post 110 between a first or "home" position (shown) and a second or "released" position for causing pivotal movement of an actuator lever 112 from a first or "non-actuated" position (shown) into a second or "actuated" position. Actuator lever 112 is supported for pivotal movement relative to a pivot post 114 and is normally biased toward its non-actuated position by an actuator lever spring 116. Actuator lever 112 is operable in its non-actuated position to disengage a first leg segment 118 from pawl release lever 40, when located in its home position, so as to permit pawl 32 to remain in its ratchet holding position. In contrast, movement of actuator lever 112 to its actuated position causes first leg segment 118 to forcibly engage and pivot pawl release lever from its home position to its pawl release position, thereby causing pawl 32 to move from its ratchet holding position to its ratchet releasing position. A second leg segment 120 of actuator lever 112 is engageable with release cam 108 due to the biasing of actuator lever spring 116. As such, rotation of power release gear 106 in its releasing direction from its home position to its released position causes corresponding pivotal movement of actuator lever 112 from its non-actuated position into its actuated position. Likewise, rotation of power release gear 106 in its resetting direction from its released position to its home position results in corresponding pivotal movement of actuator lever 112 from its actuated position to its non-actuated position.

Figure 5A:
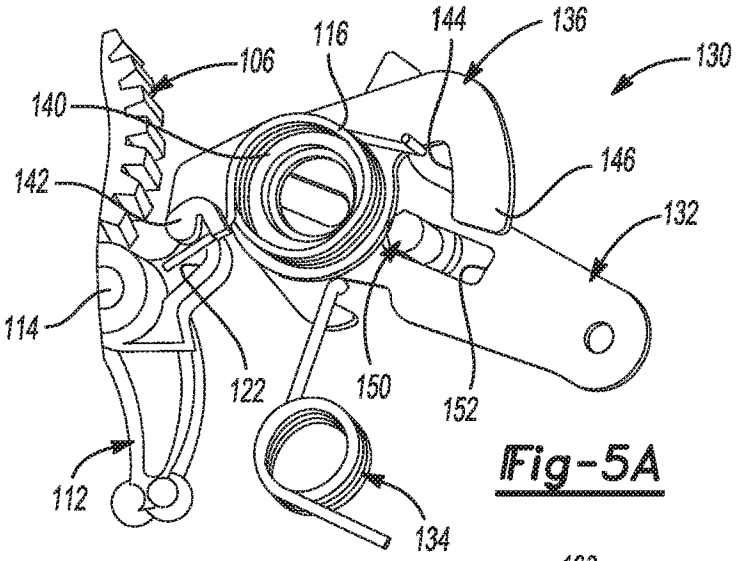
FIGS. 5A and 5B are additional views of the inside release/double pull mechanism shown in FIG. 4 for illustrating the link lever located in a disengaged position and an engaged position, respectively.
Figure 5B:
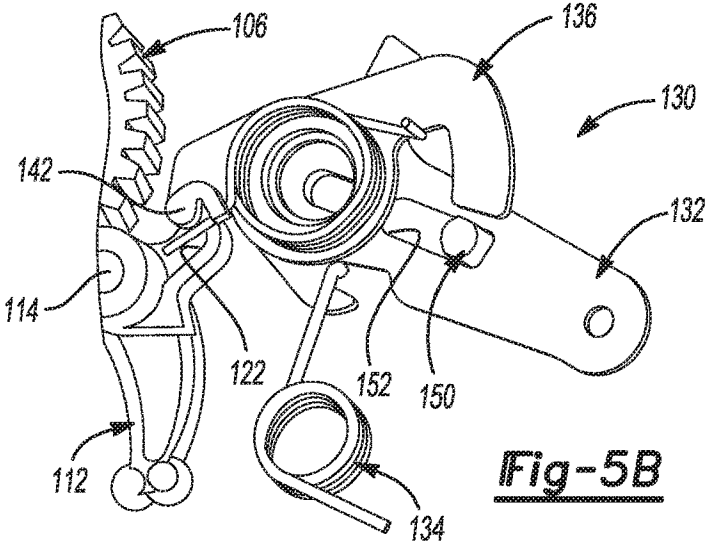
Figure 4:
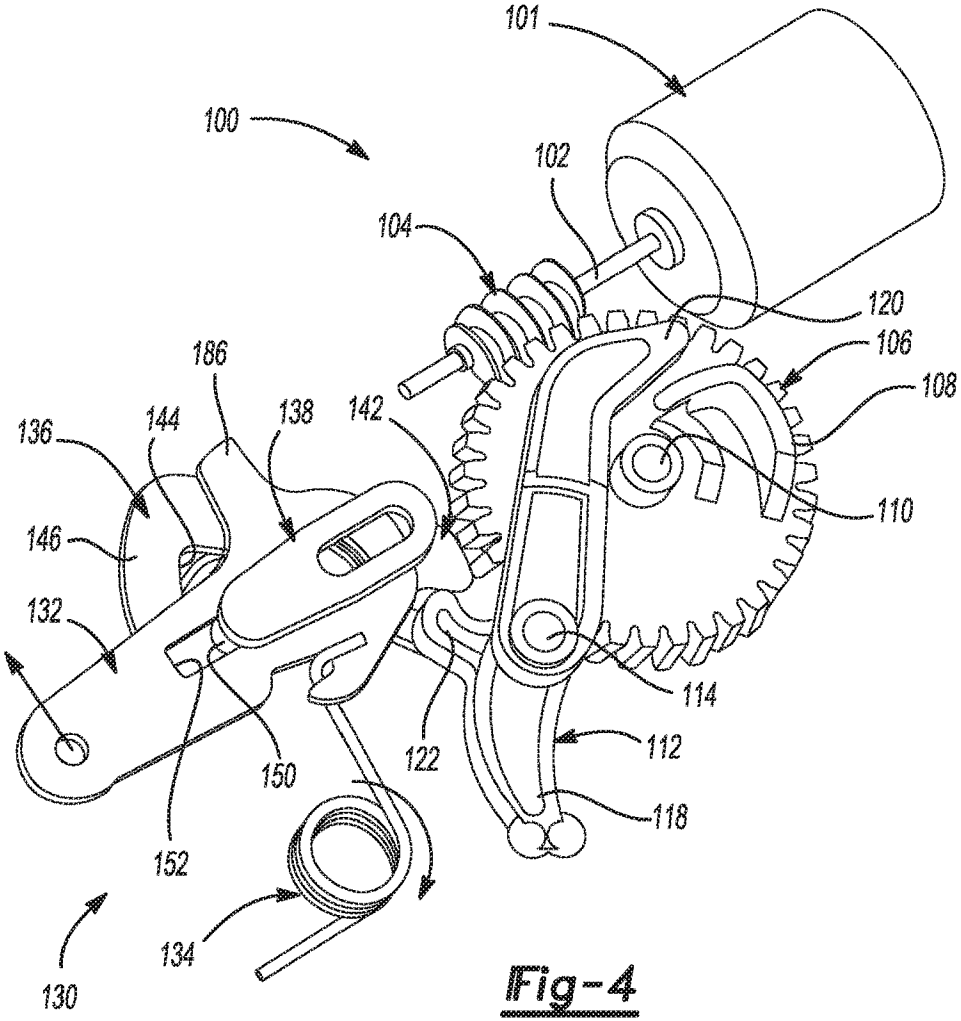
FIG. 4 is a built-up isometric view, similar to FIG. 3, but now showing the additional components of an inside release/double pull mechanism associated with the closure latch of the present disclosure.

FIG. 4 is a built-up version of FIG. 3 now illustrating a non-limiting embodiment of an inside release mechanism 130 that is operatively associated with power release mechanism 100 for use with closure latch 10. Inside release mechanism 130 is shown to include inside an release lever 132 that is pivotably moveable between a first or "home" position (shown) and a second or "actuated" position (FIG. 11), an inside release lever spring 134 operable to normally bias inside release lever 132 to its home position, an auxiliary release lever 136 and a link lever 138. Inside release lever 132 is mechanically connected via a suitable coupling mechanism (not shown) to inside door handle 26. FIGS. 5A and 5B illustrate inside release lever 132 being pivotable about a pivot post 140 on which actuator lever spring 116 is mounted. Auxiliary release lever 136 is also supported for pivotal movement relative to pivot post 140 between a first or "home" position and a second or "actuator lever release" position. Auxiliary release lever 136 is biased toward its home position via actuator lever spring 116 acting thereon. Auxiliary release lever 136 is formed to include an actuation lug 142 that is engageable with a release lug 122 formed on actuator lever 112, and a slotted portion defining a bypass cavity 144 and a drive lug 146. Link lever 138 includes an elongated slot 148 and a guide post 150 that is retained for sliding movement within a drive slot 152 formed in inside release lever 132. As seen from FIGS. 5A and 5B, guide post 150 on link lever 138 is aligned with bypass cavity 144 in auxiliary release lever 136 when link lever 138 is located in a first or "disengaged/retracted" position. In contrast, guide post 150 is aligned with drive lug 146 on auxiliary release lever 136 when link lever 138 is located in a second or "engaged/extended" position. As will be detailed, movement of inside release lever 132 between its home and actuated positions, in cooperation with movement of link lever 138 between its disengaged and engaged positions, controls selective pivotal movement of auxiliary release lever 136 between its home position and its actuator lever release position.

Figure 6:
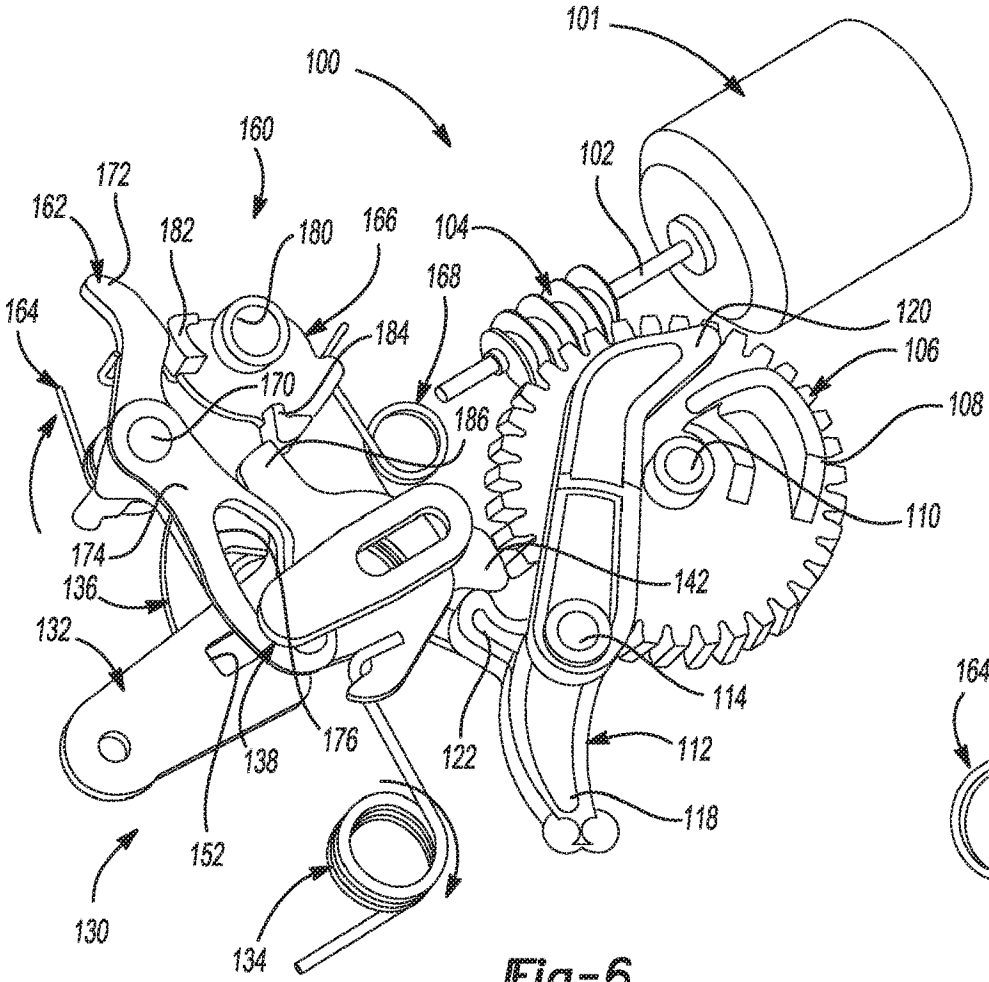
FIG. 6 is another built-up isometric view, similar to FIG. 4, but now showing the additional components of a double pull actuation mechanism associated with the closure latch of the present disclosure.

FIG. 6 is a built-up version of FIG. 4 now illustrating a non-limiting embodiment of a double pull actuation mechanism 160 that is arranged in operative association with inside release mechanism 130 for use with closure latch 10. Double pull actuation mechanism 160 is shown to generally include a double pull lever 162, a double pull lever spring 164, a double pull sector 166, and a double pull sector spring 168. Double pull lever 162 is pivotably moveable about a pivot post 170 between a first or "double pull-ON" position and a second or "double pull-OFF" position. Double pull lever spring 164 acts on double pull lever 162 and normally biases double pull lever 162 toward its double pull-OFF position. Double pull lever 162 includes a first leg segment 172 and a second leg segment 174 defining a contoured drive slot 176. As seen, second leg segment 174 is disposed between link lever 138 and inside release lever 132 such that guide post 150 on link lever 138 passes through drive slot 176 in double pull lever 162 and drive slot 152 in inside release lever 132.

Figure 7A:
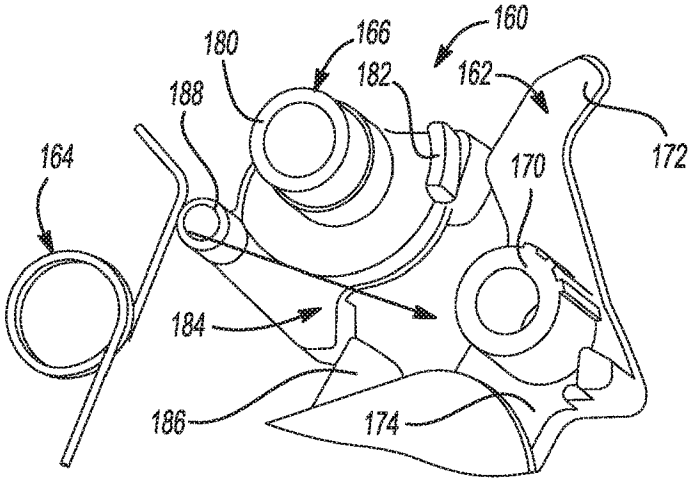
FIGS. 7A and 7B are additional views of the double pull actuation mechanism shown in FIG. 6 for illustrating the double pull sector rotated between double pull-on and double pull-off positions, respectively.
Figure 7B:
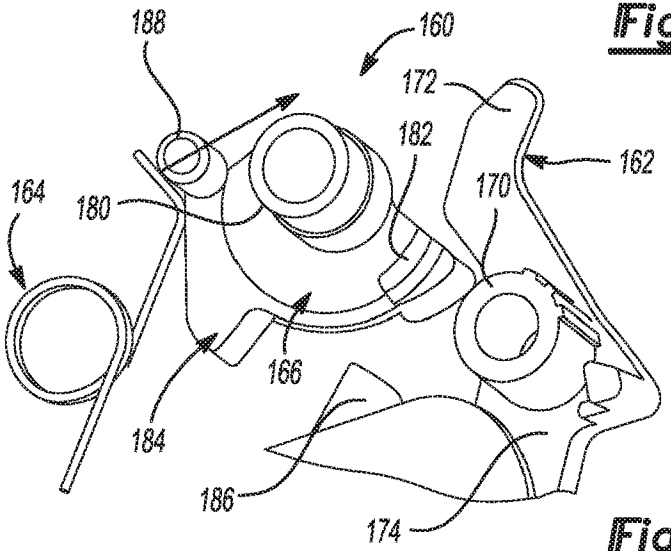

Double pull sector 166 is rotatable about a pivot post 180 and is configured to include a first lug 182 engageable with first leg segment 172 of double pull lever 162, a second lug 184 engageable with an arm segment 186 on inside release lever 132, and a third lug 188 (FIGS. 7A-7B) engageable with an end portion of double pull sector spring 168. Double pull sector 166 is rotatable between a first or "double lock ON" position and a second or "double lock OFF" position. With double pull sector 166 located in its double lock ON position (FIG. 7A) its first lug 182 engages first leg segment 172 for holding double pull lever 162 in its double pull-ON position and its second lug 184 engages arm segment 186 on inside release lever 132 when inside release lever 132 is located in its home position. In contrast, location of double pull sector 166 in its double lock OFF position (FIG. 7B) acts to release engagement between first leg segment 172 and first lug 182 so as to permit double pull lever 162 to move to its double pull OFF position due to the biasing of double pull lever spring 164. In addition, second lug 184 is disengaged from arm segment 186 on inside release lever 132. Double pull sector spring 168 acts as an over-center biasing device, as indicated by the directional arrows shown in FIGS. 7A and 7B.

Figure 8:
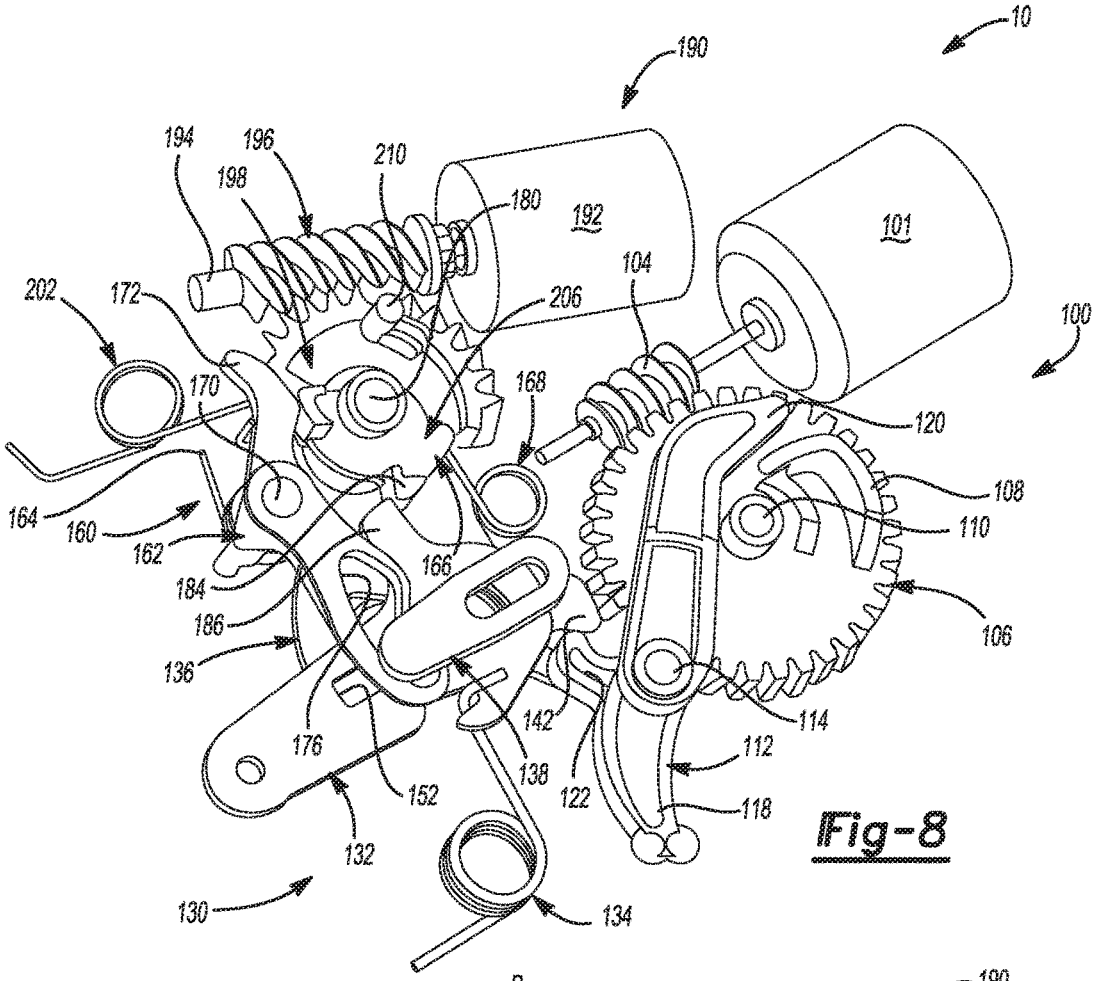
FIG. 8 is yet another built-up isometric view, similar to FIG. 6, but now showing the additional components of a power child lock mechanism associated with the closure latch of the present disclosure.
Figure 9:
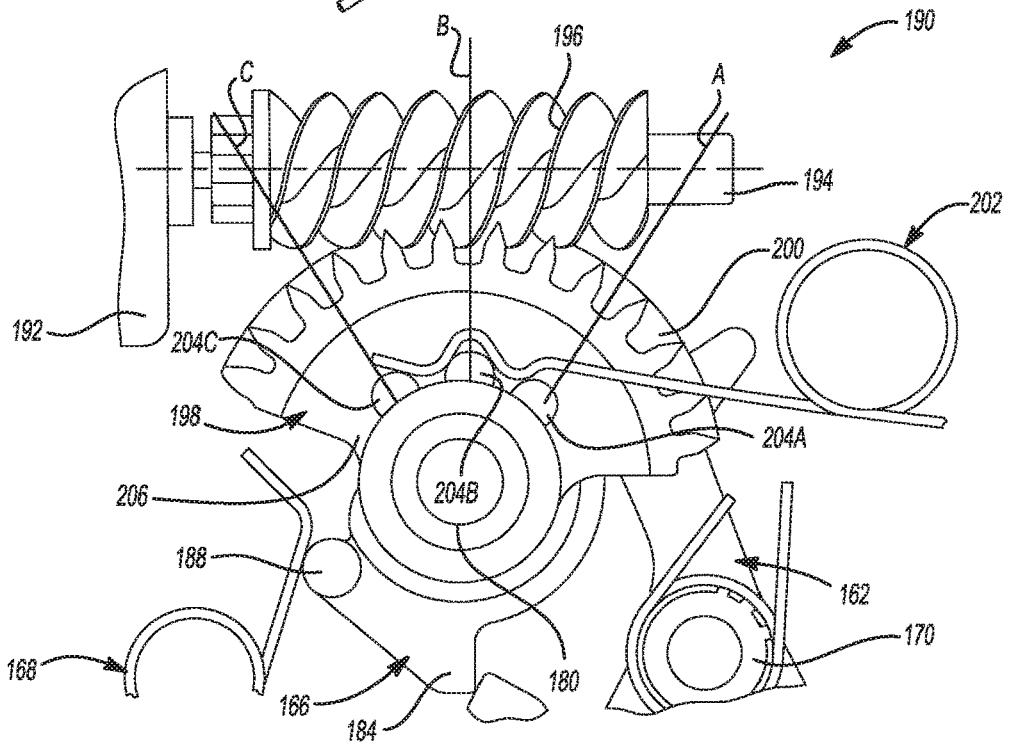
FIG. 9 is a view of the power child lock mechanism shown in FIG. 8 for illustrating the three (3) distinct positions of the child lock sector.

FIG. 8 is a built-up version of FIG. 6 now illustrating a non-limiting embodiment of a power child lock mechanism 190 that is arranged in operative association with double pull actuation mechanism 160 for use with closure latch 10. Power child lock mechanism 190 is shown generally to include a power lock actuator having an electric motor 192 with an output shaft 194 driving a worm gear 196, a child lock sector 198 having teeth 200 meshed with the threads of worm gear 196, and a child lock sector spring 202. Child lock sector 198 is rotatable on pivot post 180 between three distinct sector positions (best shown in FIG. 9) to include a first or "child lock ON/double pull OFF" position (denoted by line "A"), a second or "child lock OFF/double pull OFF" position (denoted by line "B"), and a third or "child lock ON" position (denoted by line "C"). Child lock sector spring 202 has a bent toggle section engageable with one of three distinct sector lugs 204A, 204B, 204C to positively locate child lock sector 198 in one of its three distinct positions.

Figure 10:
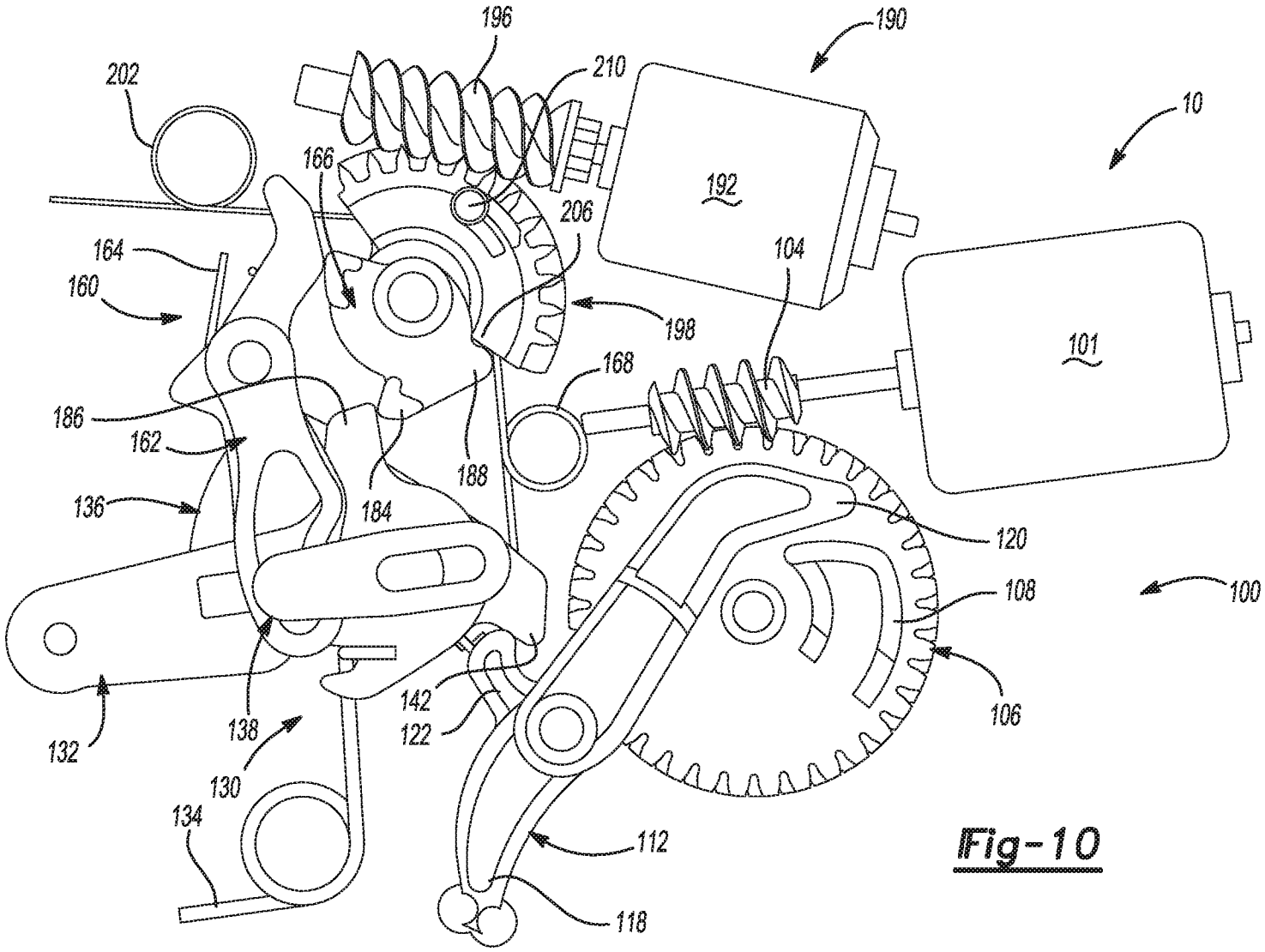
FIG. 10 illustrates the built-up closure latch shown in FIG. 8 with the components oriented and located to establish a first operating state with the power child lock mechanism in a Child Unlock mode and the double pull actuation mechanism in a Lock mode.

The following description in association with FIGS. 10-21 is provided to disclose the movement and operation of the components disclosed in FIGS. 3 through 9 for establishing a plurality of distinct operating state for closure latch 10. In this regard, FIG. 10 illustrates the components located and oriented to establish a first operating state for closure latch 10 wherein inside release mechanism 130 is operating in a Lock mode, double pull actuation mechanism 160 is operating in a Lock mode, and power child lock mechanism 190 is operating in a Child Unlock mode. As seen, power release gear 106 is located in its home position, actuator lever 112 is located in its non-actuated position, inside release lever 132 is located in its home position, auxiliary release lever 136 is located in its home position, link lever 138 is located in its disengaged/retracted position, double pull lever 162 is located in its double pull-ON position, double pull sector 166 is located in its double lock ON position, and child lock sector 198 is located in its first sector position. With this arrangement, second lug 184 on double pull sector 166 is in engagement with arm segment 186 on inside release lever 132 and third lug 188 on double pull sector 166 is in engagement with a flanged end segment 206 of child lock sector 198.

The Lock-Unlock status of closure latch 10 is defined by ECU 60. In the event that the door status is Unlock, ECU 60 will actuate power release motor 101 and rotate power release gear 106 in the releasing direction to its released position in response to movement of inside release lever 132 to its actuated position via a first pull on inside handle 26, thereby causing release cam 108 to engage first leg segment 118 and drive actuator lever 112 to its actuated position for unlatching the latch mechanism. However, in the event that the door status is Lock, ECU 60 will not actuate power release motor 101 after the first pull on inside handle 26, but rather will wait for a second pull on inside handle 26 before actuating power release motor 101 to power release the latch mechanism.

Figure 11:
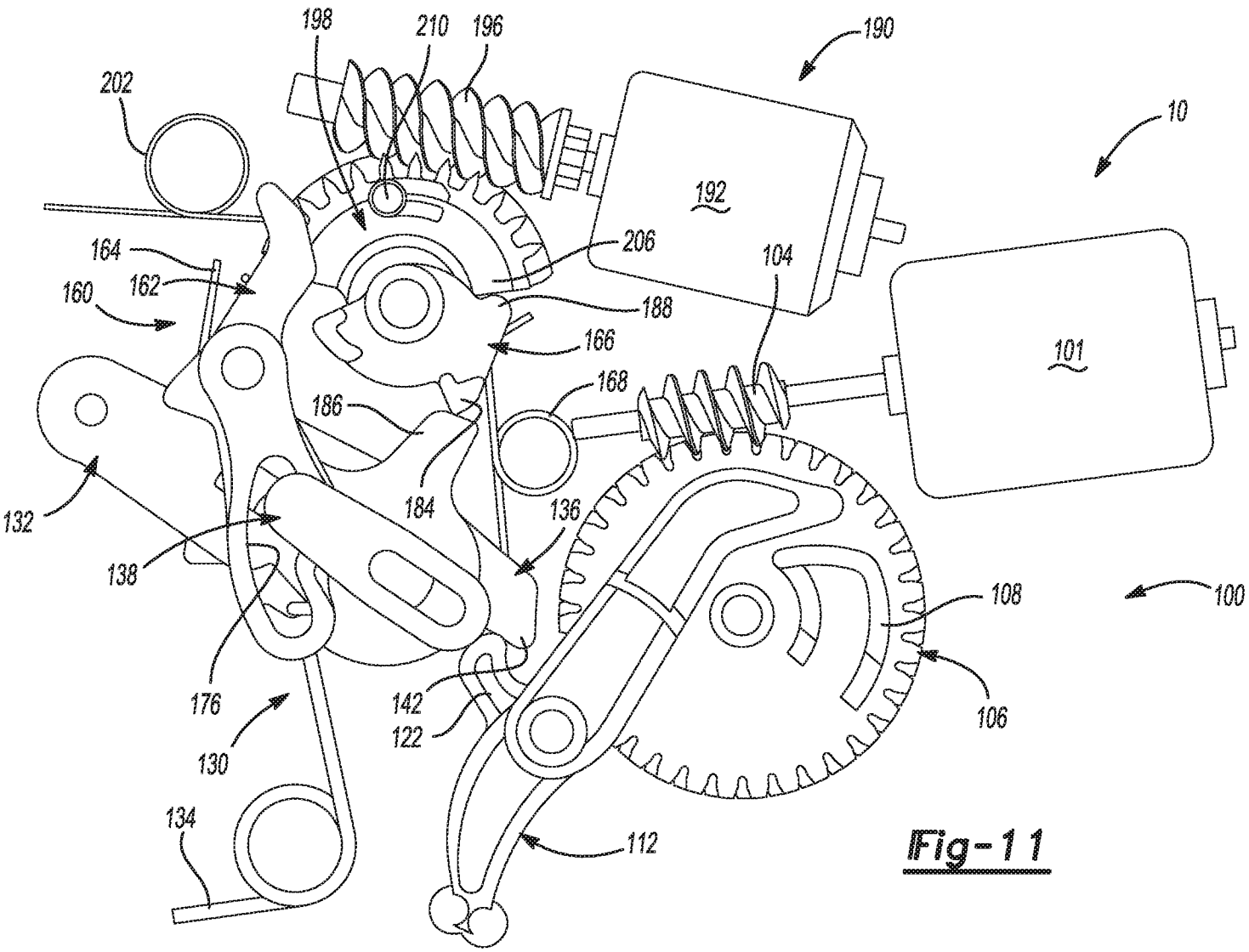
FIG. 11 illustrates the closure latch of FIG. 10 with the components oriented and located after a first pull on an inside release lever to initiate a double pull inside release operation for establishing a second operating state with the power child lock mechanism maintained in the Child Unlock mode and the double pull actuation mechanism shifted into an Unlock mode.

FIGS. 11 through 15 illustrate a series of sequential views associated with a double pull inside release operation for shifting closure latch 10 from its first operating state (FIG. 10) into a second operating state wherein inside release mechanism 130 is shifted into an Unlock mode, double pull actuation mechanism 160 is shifted into an Unlock mode, and power child lock mechanism 190 remains in its Child Unlock mode. FIG. 11 illustrates movement of the components associated with a first pull on inside handle 26 causing inside release lever 132 to pivot from its home position into its actuated position. Such movement of inside release lever 132 causes concurrent rotation of double pull sector 166 from its double lock ON position to its double lock OFF position due to engagement of arm segment 186 with second lug 184. In addition, such movement of double pull sector 166 to its double lock OFF position causes concurrent rotation of child lock sector 198 from its first sector position to its second sector position due to engagement of third lug 188 with flanged end segment 206. Link lever 138 pivots in conjunction with this first pull movement of inside release lever 132 due to guide post 150 being retained in drive slot 152. However link lever 138 is maintained in its disengaged/retracted position. The contour of drive slot 176 is configured such that double pull lever 162 is retained in its double pull-ON position during the first pull operation. Since link lever 138 is maintained in its disengaged/retracted position, guide post 150 remains aligned with bypass cavity 144 such that auxiliary release lever 136 is maintained in its home position during the first pull. If the door status is Lock, ECU 60 receives an inside door release signal from an inside door release sensor and changes the status from Lock to Unlock. However, if the door status is Unlock, ECU 60 receives the inside release signal and actuates power release motor 101 to rotate power release gear 106 to its released position for completing a power release function.

Figure 12:
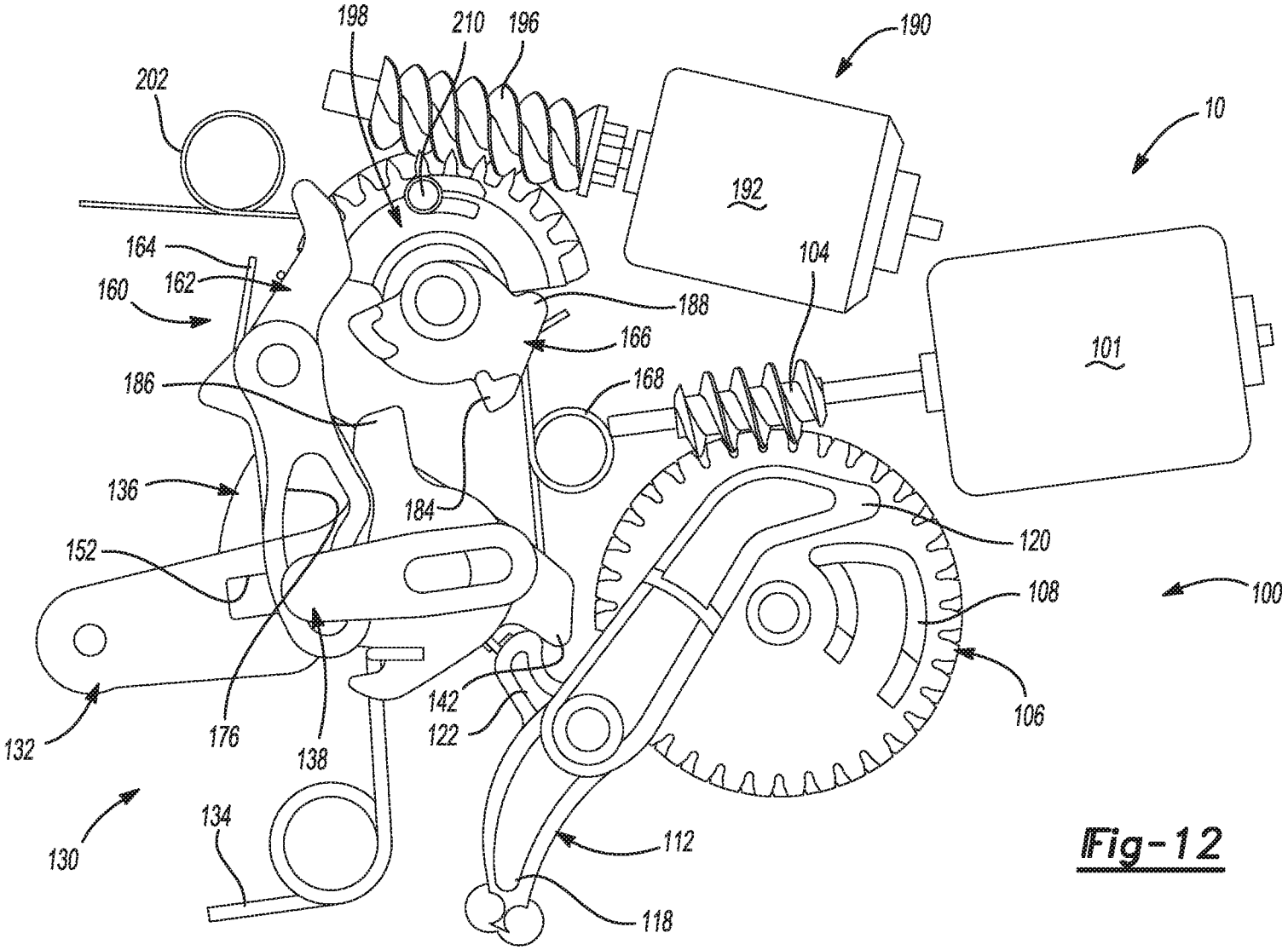
FIGS. 12 through 15 sequentially illustrate the built-up closure latch shown in FIG. 11 with the components oriented and located following completion of the first pull, initiation of a second pull, and completion of the second pull of the double pull inside release operation.
Figure 13:
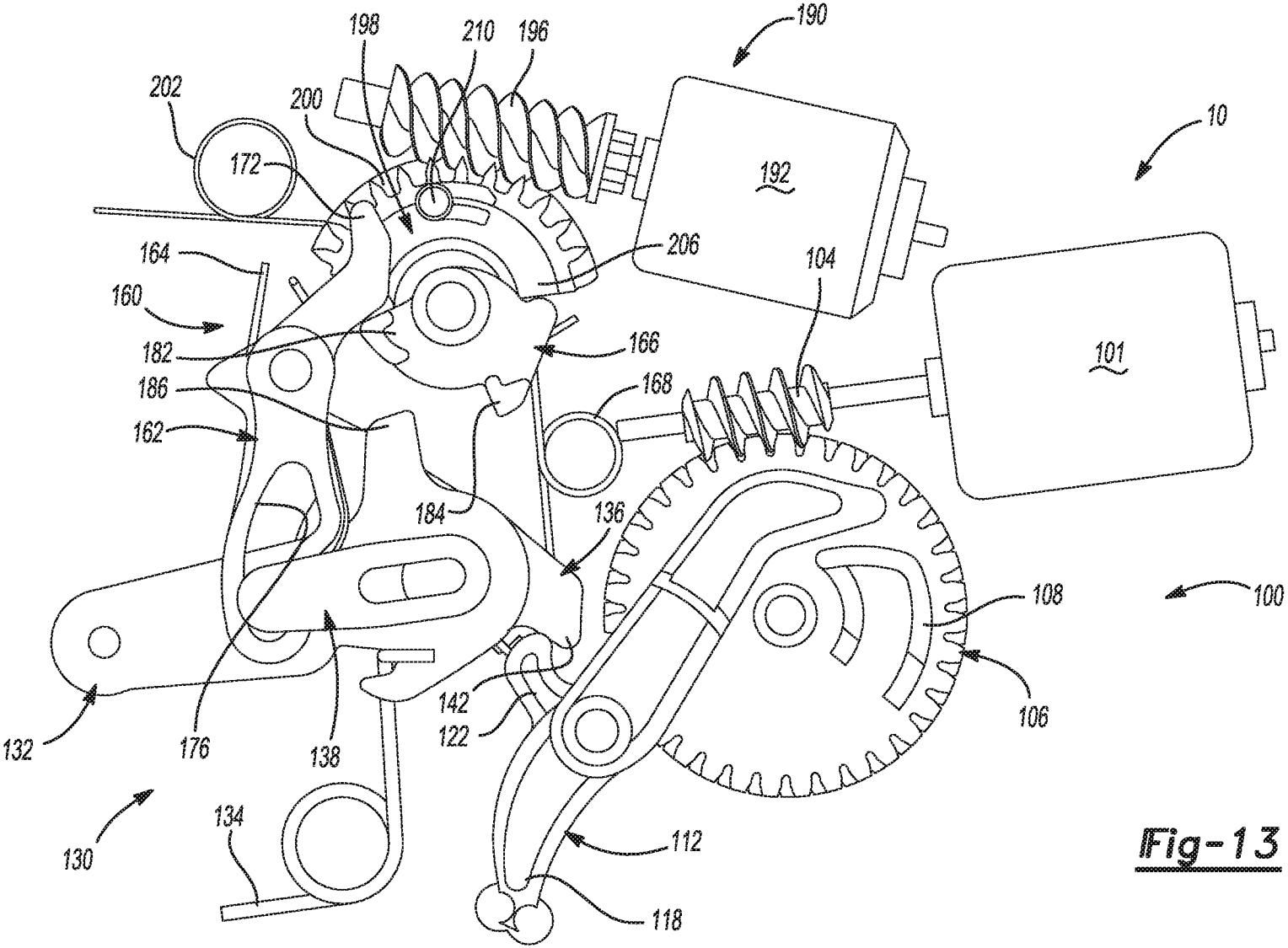
Figure 14:
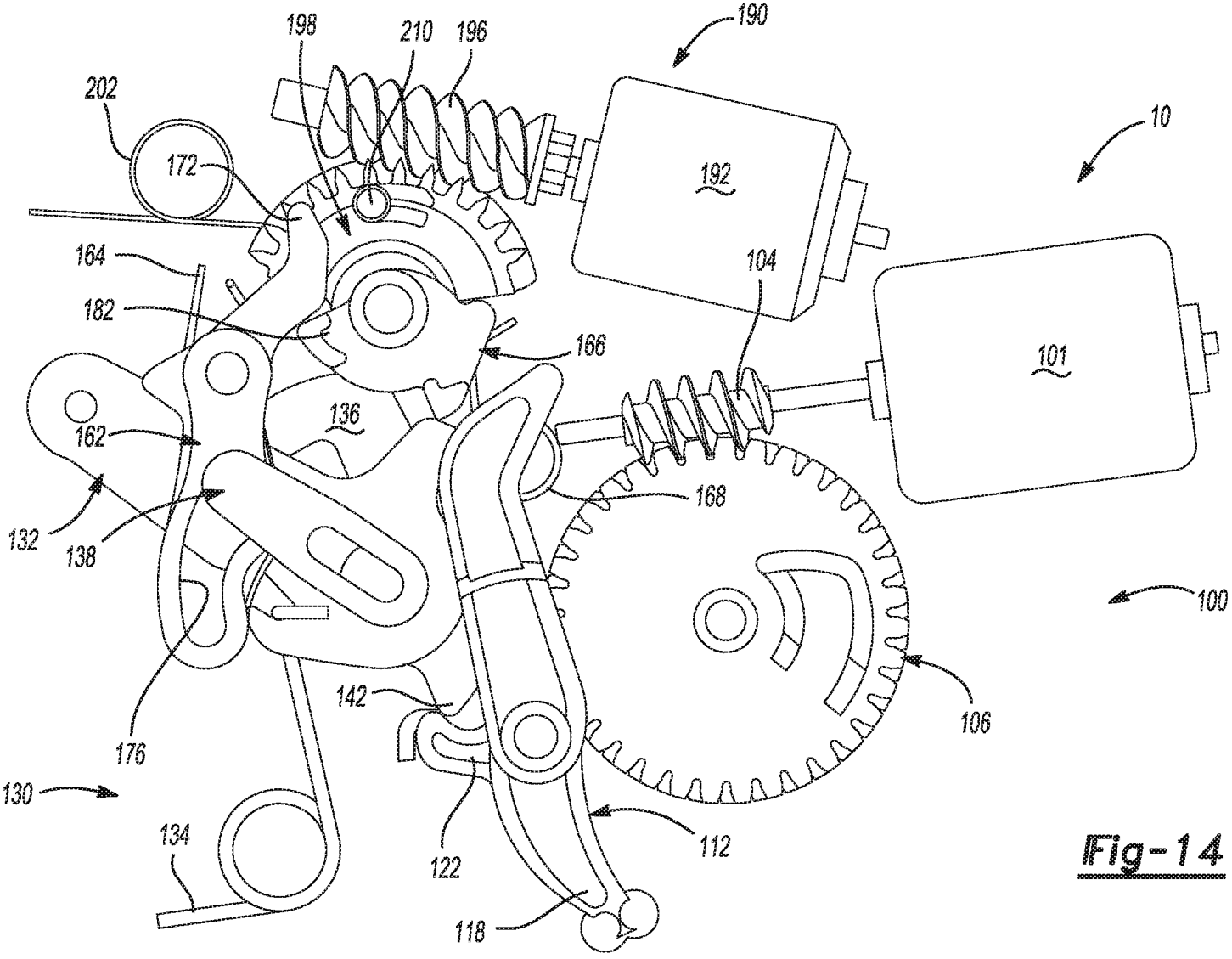
Figure 15:
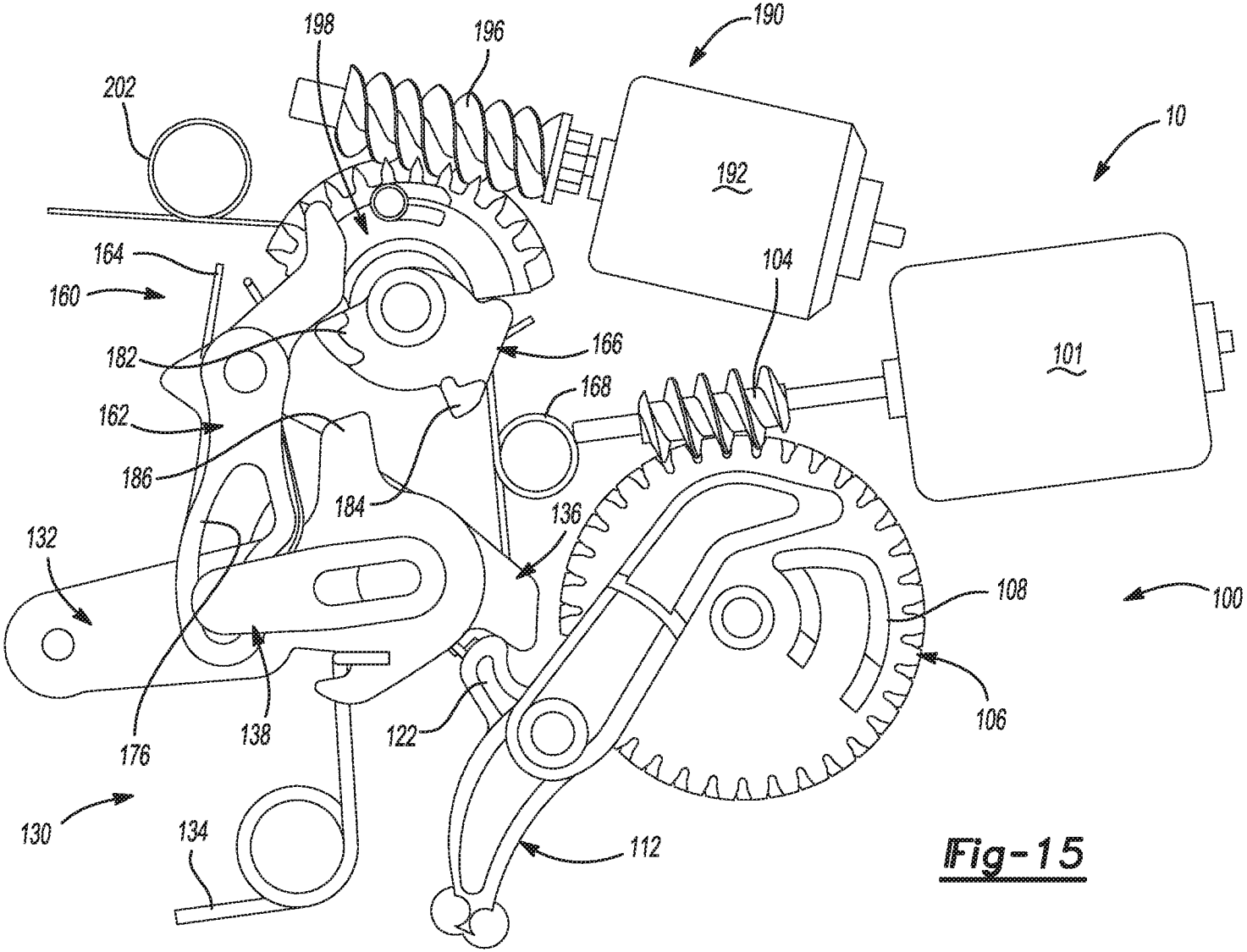

FIG. 12 illustrates return of inside release lever 132 to its home position following release of inside handle 26 upon completion of the first pull operation. FIG. 13 illustrates that upon return of inside release lever 132 to its home position, first leg segment 172 on double pull lever 162 is disengaged from first lug 182 on double pull sector 166 such that double pull lever spring 164 is permitted to pivot double pull lever 162 from its double pull-ON position (FIG. 11) into its double pull-OFF position. Such movement of double pull lever 162 causes link lever 138 to move into its engaged/extended position due to guide post 150 being retained within contoured drive slot 176. As noted, movement of link lever 138 to its engaged/extended position results in alignment of guide post 150 with drive lug 146 on auxiliary release lever 136. FIG. 14 illustrates movement of the components associated with a second pull on inside handle 26 during the double pull inside release operation. As seen, pivotal movement of inside release lever 132 from its home position (FIG. 13) to its actuated position causes concurrent pivotal movement of link lever 138. However, since link lever 138 is now located in its engaged/extended position, such pivotal movement of link lever 138 results in guide post 150 engaging drive lug 146 and forcibly pivoting auxiliary release lever 136 from its home position to its actuator lever release position. Such pivotal movement of auxiliary release lever 136 causes its actuation lug 142 to engage release lug 122 on actuator lever 112 for pivoting actuator lever 112 from its non-actuated position to its actuated position, thereby mechanically unlatching the latch mechanism. Finally, FIG. 15 illustrates return of inside release lever 132 to its home position upon completion of the second pull operation. Since double pull lever 162 is held in its double pull-OFF position, link lever 138 is held in its engaged/extended position.

Figure 16:
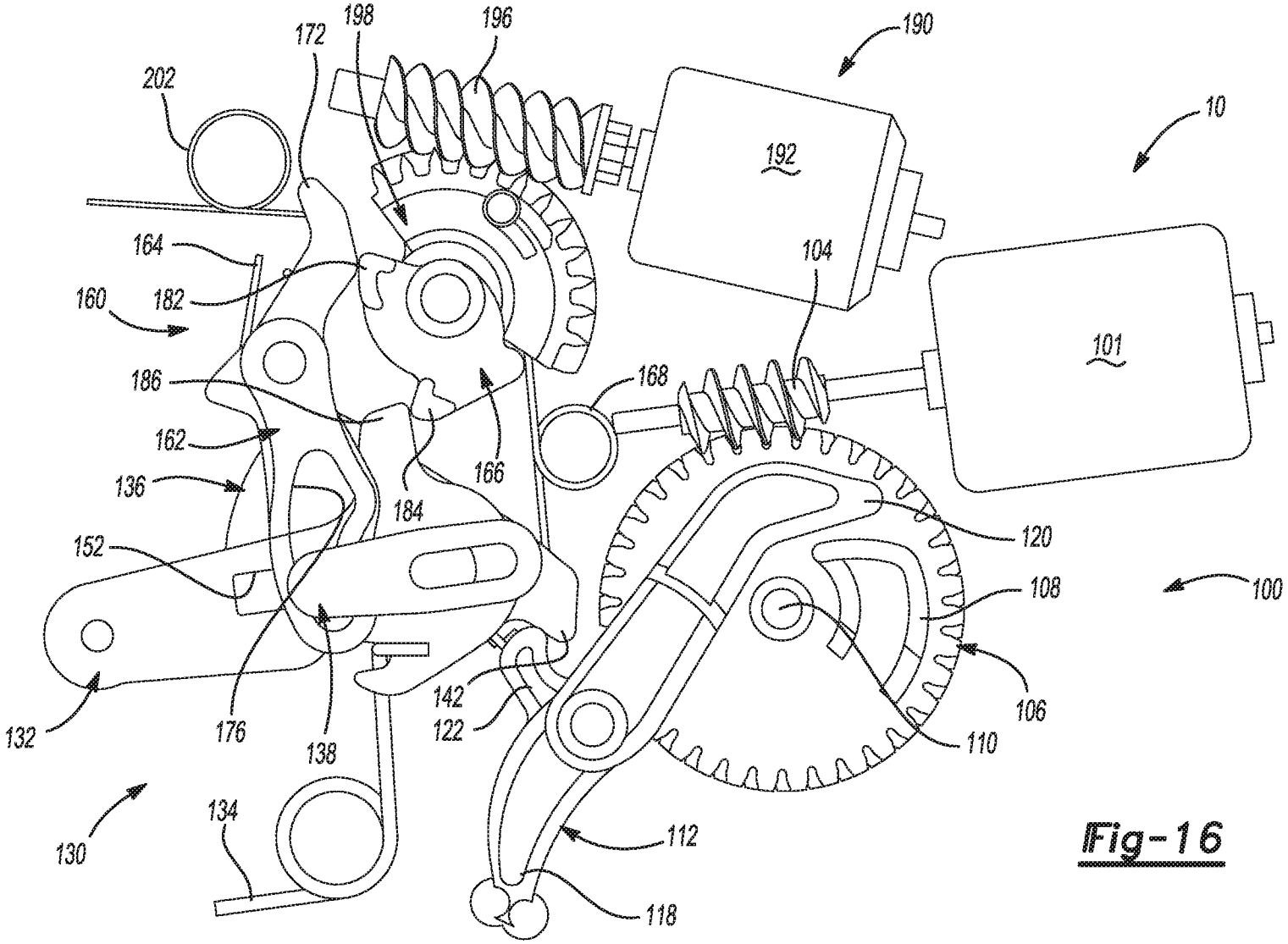
FIG. 16 illustrates the closure latch of FIG. 15 with the components moved to reset the closure latch in its first operating mode.

FIG. 16 illustrates the resetting or relocking of closure latch 10 into its first operating state upon completion of the double pull release operation. Specifically, ECU 60 actuates child lock motor 192 to drive child lock sector 198 from its second sector position (FIG. 11) into its third sector position. Such rotation of child lock sector 198 causes flanged end segment 206 to engage third lug 188 on double pull sector 166 and rotate double pull sector 166 from its double lock OFF position back to its double lock ON position. This rotation of double pull sector 166 causes first lug 182 to engage first leg segment 172 of double pull lever 162 and forcibly pivot double pull lever 162 from its double pull-OFF position to its double pull-ON position which, in turn, results in movement of link lever 138 from its engaged/extended position to its disengaged/retracted position. Thus, the first operating state (FIG. 10) of closure latch 10 is re-established.

Figure 17:
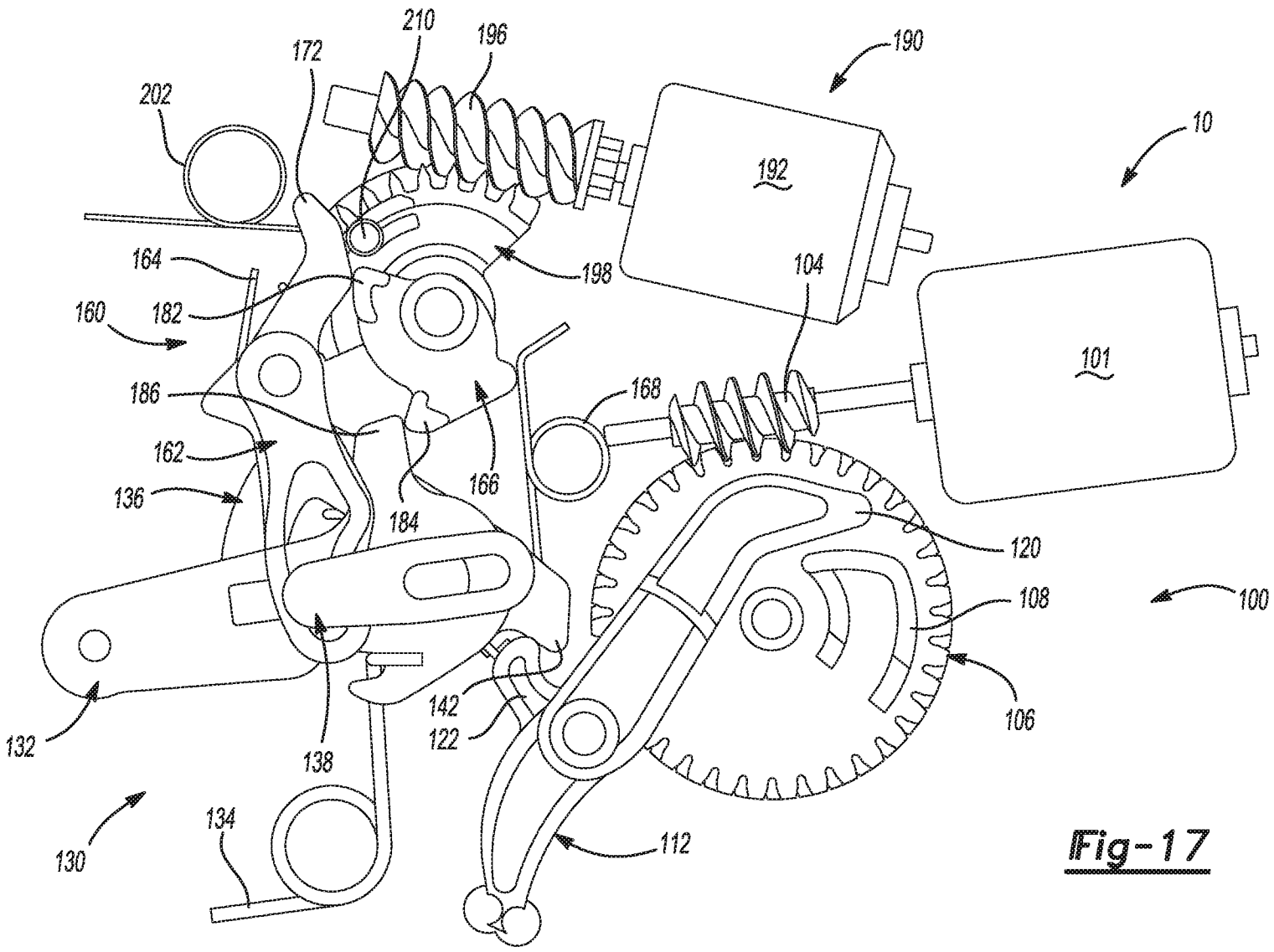
FIG. 17 illustrates the closure latch of FIG. 16 with the components oriented and located to establish a third operating state with the power child lock mechanism in a Child Lock mode and the double pull actuation mechanism in the Lock mode.
Figure 18:
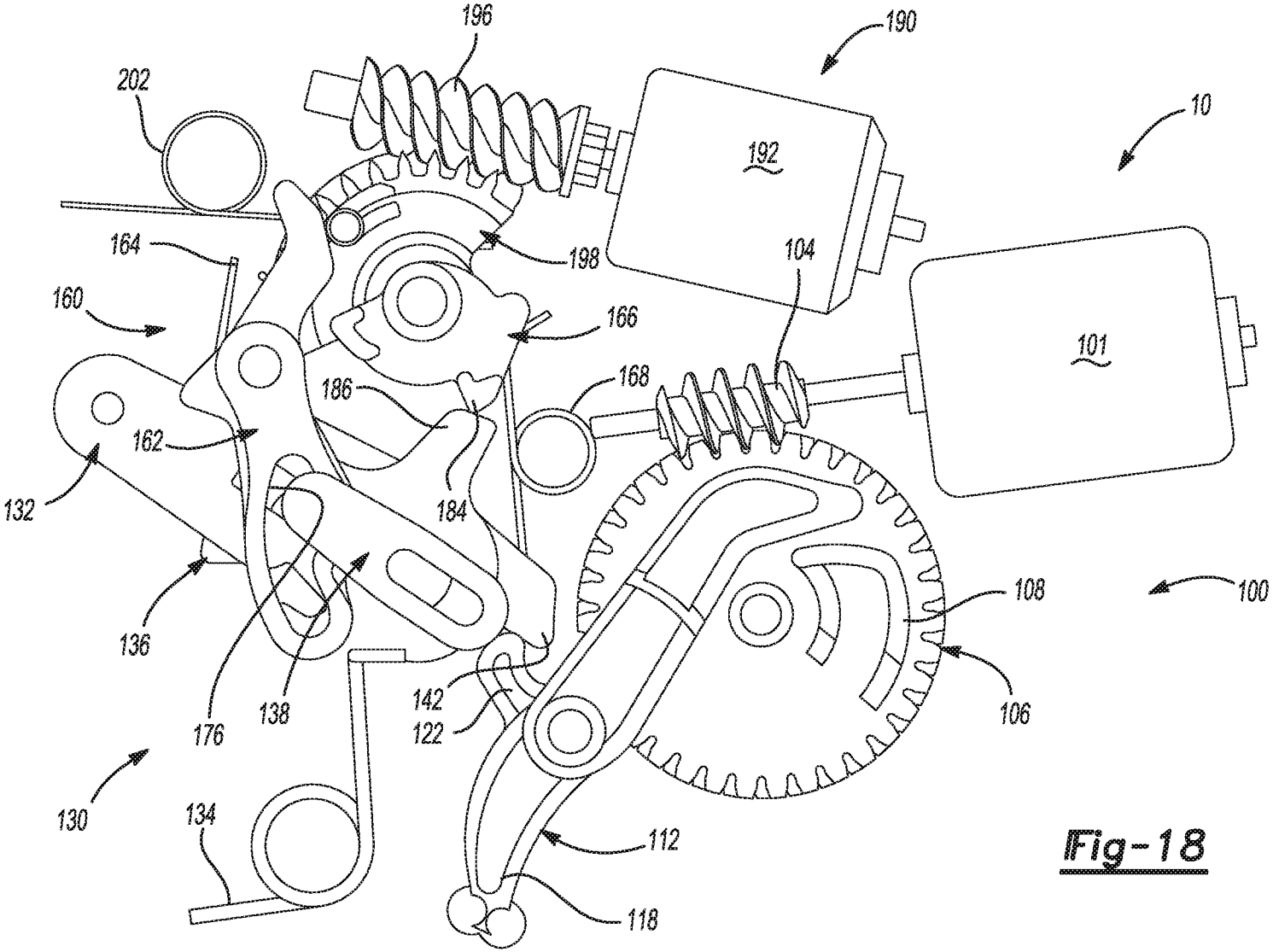
FIGS. 18 and 19 illustrate the closure latch of FIG. 17 with the components oriented and located to establish a fourth operating state with the power child lock mechanism in the Child Lock mode and the double pull actuation mechanism in the Unlock mode.
Figure 19:
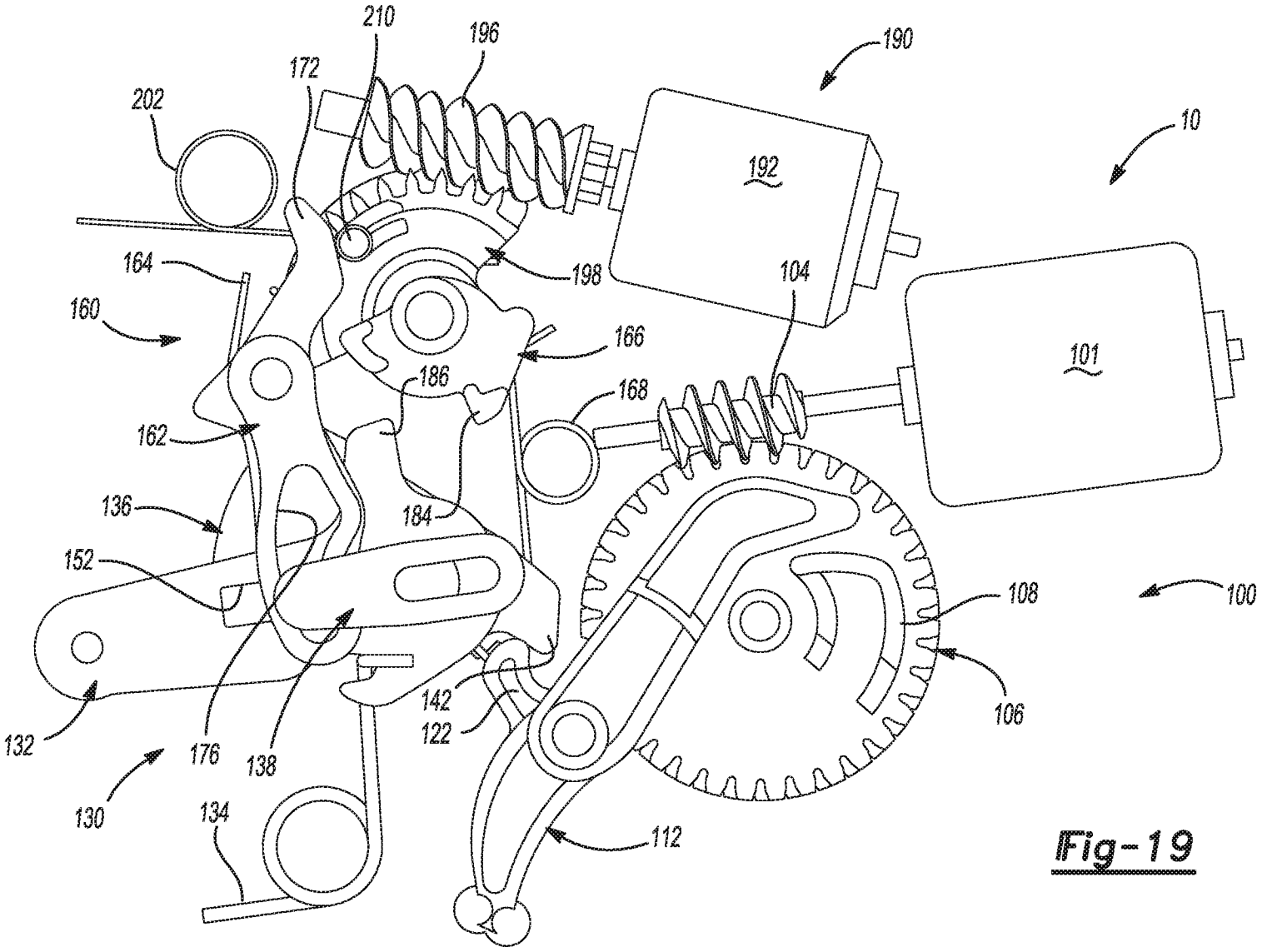

FIG. 17 illustrates the components located and oriented to shift closure latch 10 from the first operating state into a third operating state by shifting power child lock mechanism 190 from its Child Unlock mode into a Child Lock mode. In comparison to FIG. 10 which illustrates the components located to establish the first operating state, ECU 60 actuates child lock motor 192 to rotate child lock sector 198 in the child locking direction from its first sector position to its third sector position. As seen, a lock lug 210 formed on child lock sector 198 engages first leg segment 172 of double pull lever 162 which is located in its double pull-ON position. FIG. 18 illustrates a first pull on inside handle 26 after the power child lock mode has been established. As seen, inside release lever 132 moves to its actuated position and causes double pull sector 166 to rotate from its double lock ON position into its double lock OFF position. In the case of closure latch 10 being in its lock state, ECU 60 receives the inside release signal and changes the status from Lock to Unlock. In the Unlock status, ECU 60 receives the inside release signal indicating a first pull on inside handle 26, but does not actuate power release motor 101 due to the pre-existing child lock status. FIG. 19 illustrates that upon completion of the first pull, inside release lever 132 returns to its home position. However, engagement of first leg segment 172 on double pull lever 162 with lock lug 210 on child lock sector 198 prevents double pull lever 162 from pivoting to its double pull-OFF position which, in turn, holds link lever 138 in its disengaged/retracted position with guide post 150 aligned with bypass cavity 144 in auxiliary release lever 136. As such, a second pull will not function to release the latch mechanism since auxiliary release lever 136 is uncoupled from inside release lever 132 for maintaining actuator lever 112 in its non-actuated position. Thus, FIGS. 18 and 19 define a fourth operating state of closure latch 10 with power lock mechanism 190 maintained in its Child Lock mode while inside release mechanism 130 and double pull actuation mechanism 160 are shifted back into their respective Unlock mode.

Figure 20:
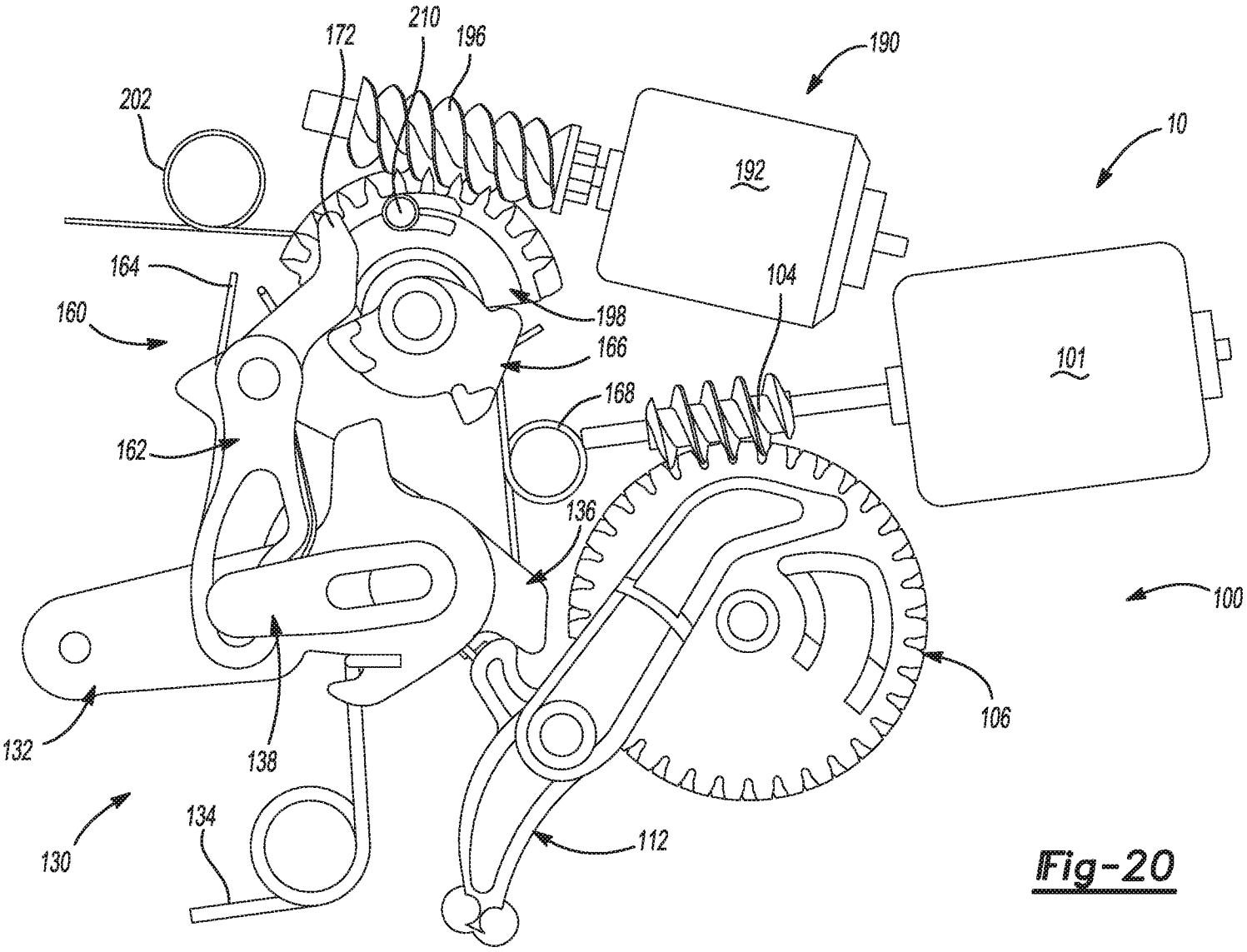
FIGS. 20 and 21 illustrate the closure latch of FIG. 19 with the components oriented and located to shift from the fourth operating state back into the first operating state.
Figure 21:
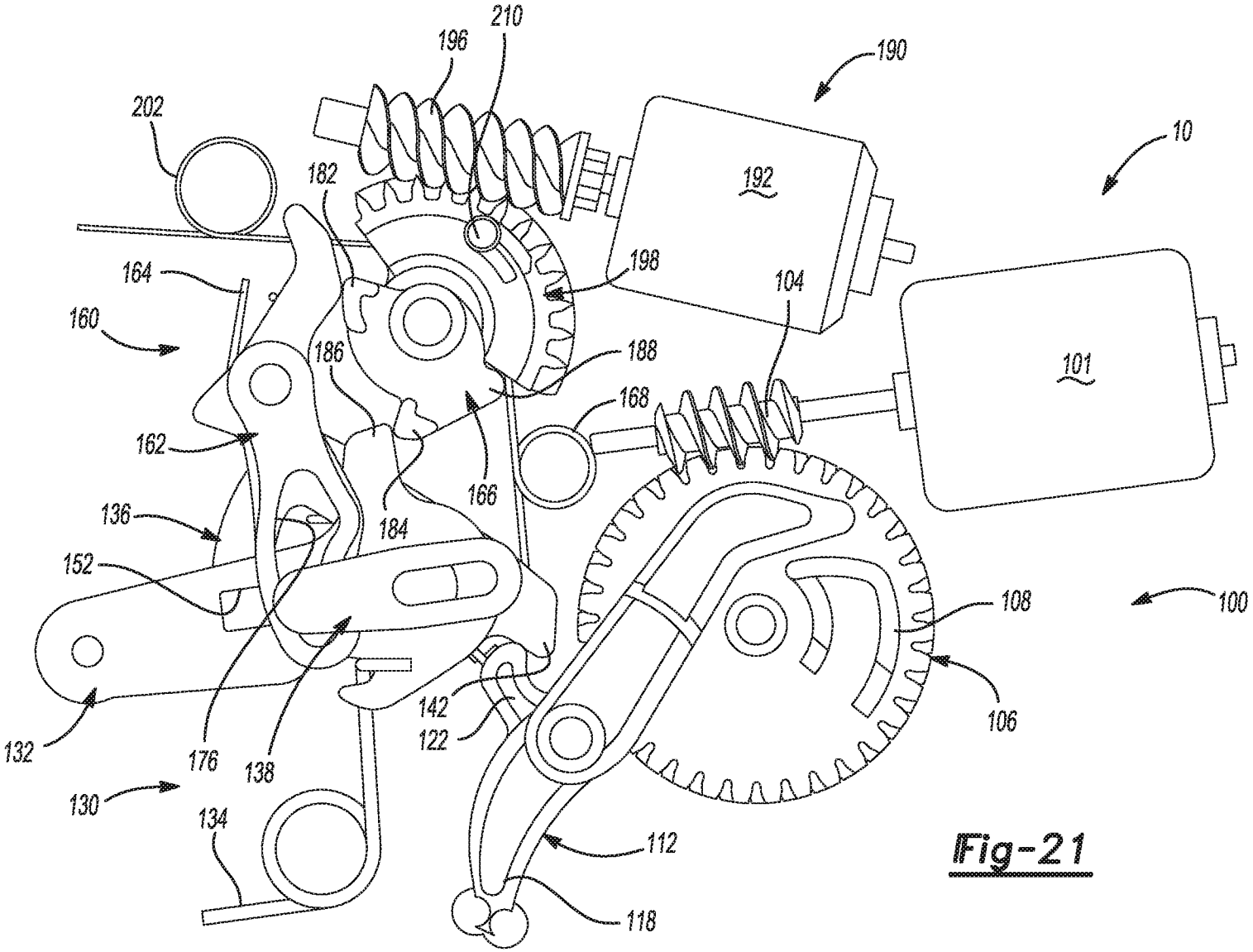

FIGS. 20 and 21 illustrate the components oriented and located to shift closure latch from the fourth operating state (FIG. 19) back to its first operating mode (FIG. 10). To accomplish this, power child lock motor 192 is powered to rotate child lock sector 198 in an unlocking direction from its third sector position to first sector position. FIG. 20 illustrates initial rotation of child lock sector 198 from its third sector position into its second sector position. This action re-engages end segment 206 with third lug 188 and also releases engagement of first leg segment 172 on double pull lever 162 with lock lug 210 on child lock sector 198. As such, double pull lever 162 is permitted to pivot to its double pull-OFF position due to the biasing of spring 164 which, in turn, drives link lever 138 from its disengaged/retracted position to its engaged/extended position. FIG. 20 shows continued rotation of child lock sector 198 from its second sector position into its first sector position via actuation of child lock motor 192. This continued rotation results in child lock sector 198 rotating double pull sector 166 to its double lock ON position which, in turn, acts to pivot double pull lever from its double pull-OFF position back to its double pull-ON position in opposition to the biasing of spring 164. Movement of double pull lever 162 to its double pull-ON position results in movement of link lever 138 from its engaged/extended position to its disengaged/retracted position.

The present disclosure describes a power-release type of closure latch with the double pull inside release feature driven by, or associated with, a power-operated child lock mechanism. This power release closure latch is well-suited in door closure systems configured with no mechanical linkage or connection device to the outside door handle. Thus, an existing actuator, namely the power-operated child lock mechanism, is used to manage the double pull inside release function. The power child lock mechanism functions to shift into its Child Unlock mode to activate the double pull functionality.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A closure latch for a vehicle door, comprising:

a latch mechanism including a ratchet and a pawl, the ratchet being moveable between a striker capture position and a striker release position, the pawl being moveable between a ratchet holding position whereat the pawl holds the ratchet in its striker capture position and a ratchet releasing position whereat the pawl permits the ratchet to move to its striker release position;

a power release mechanism having an actuator lever operatively connected to the pawl and a power release actuator, the actuator lever being moveable between a non-actuated position whereat the pawl is maintained in its ratchet holding position and an actuated position whereat the actuator lever moves the pawl to its ratchet releasing position, the power release actuator being operable to move the actuator lever from its non-actuated position to its actuated position;

an inside release mechanism including an inside release lever, an auxiliary release lever and a link lever, the inside release lever being coupled to an inside door handle and being moveable between a home position and an actuated position in response to actuation of the inside door handle, the auxiliary release lever being moveable between a home position whereat the actuator lever is maintained in its non-actuated position and an actuator lever release position whereat the auxiliary release lever moves the actuator lever to its actuated position, the link lever being moveable between a disengaged position whereat the inside release lever is disconnected from the auxiliary release lever and an engaged position whereat the link lever operatively couples the inside release lever to the auxiliary release lever such that movement of the inside release lever between its home and actuated positions results in concurrent movement of the auxiliary release lever between its home and actuator lever release positions;

a double pull actuation mechanism including a double pull lever and a double pull sector, the double pull lever being operatively coupled to the link lever and moveable between a double pull-ON position whereat the double pull lever holds the link lever in its disengaged position and a double pull-OFF position whereat the double pull lever moves the link lever to its engaged position, the double pull sector being moveable relative to the double pull lever between a double lock ON position whereat the double pull sector holds the double pull lever in its double pull-ON position and a double lock OFF position whereat the double pull sector permits the double pull lever to move relative to the double pull sector to its double pull-OFF position, wherein movement of the inside release lever from its home position to its actuated position causes movement of the double pull sector from its double lock ON position to its double lock OFF position; and a power child lock mechanism having a child lock sector and a power lock actuator, the child lock sector being moveable by the power lock actuator between three distinct sector positions including a first sector position whereat the child lock sector holds the double pull sector in its double lock ON position, a second sector position whereat the double pull sector is located in its double lock OFF position, and a third sector position whereat the child lock sector holds the double pull lever in its double pull-ON position, the power lock actuator being operable to rotate the child lock sector.

2. The closure latch of claim 1 wherein the inside release lever includes an elongated guide slot, wherein the link lever includes a guide post disposed in the guide slot for movement of the link lever between its disengaged and engaged positions relative to the inside release lever, and wherein the auxiliary release lever includes a bypass cavity and a drive lug such that the guide post is aligned with the bypass cavity when the link lever is located in its disengaged position and the guide post is aligned with the drive lug when the link lever is located in its engaged position.

3. The closure latch of claim 2 wherein the double pull lever includes a drive slot through which the guide post extends and which is configured to locate the link lever in its disengaged position when the double pull lever is located in its double pull-ON position and to locate the link lever in its engaged position when the double pull lever is located in its double pull-OFF position.

4. The closure latch of claim 1 wherein the power release actuator includes a power release motor operable for rotating a power release gear between a home position and a released position, and wherein rotation of the power release gear in a releasing direction from its home position to its released position causes a release cam fixed to the power release gear to move the actuator lever from its non-actuated position to its actuated position.

5. The closure latch of claim 1 wherein the power release mechanism further includes an actuator lever biasing member for biasing the actuator lever toward its non-actuated position, wherein the inside release mechanism further includes an inside release lever biasing member for biasing the inside release lever toward its home position, and wherein the double pull actuation mechanism further includes a double pull lever biasing member for biasing the double pull lever toward its double pull-OFF position.

6. The closure latch of claim 5 wherein the power child lock mechanism further includes a child lock sector spring configured to positively locate and hold the child lock sector in each of its three distinct sector positions.

7. The closure latch of claim 1 wherein the double pull sector includes a first lug adapted to engage and hold the double pull lever in its double pull-ON position when the double pull sector is located in its double lock ON position, and a second lug adapted to engage an arm segment formed on the inside release lever such that movement of the inside release lever to its actuated position causes the arm segment to engage the second lug and cause rotation of the double pull sector to its double lock OFF position.

8. The closure latch of claim 7 wherein the double pull sector includes a third lug in engagement with the child lock sector for rotating the child lock sector from its first sector position to its second sector position in response to movement of the double pull sector from its double lock ON position to its double lock OFF position, and wherein actuation of the power lock actuator for rotating the child lock sector from its second sector position to its first sector position causes the child lock sector to engage the third lug and rotate the double pull sector from its double lock OFF position to its double lock ON position.

9. The closure latch of claim 1 wherein rotation of the child lock sector from either of its first and second sector positions to its third sector position results in a lock lug formed on the child lock sector engaging and holding the double pull lever in its double pull-ON position for establishing a power child locked mode.

10. The closure latch of claim 9 wherein rotation of the child lock sector from its third sector position to its second sector position by the power lock actuator permits the double pull lever to move to its double pull-OFF position with the link lever located in its engaged position to establish a power child unlocked mode.

11. The closure latch of claim 10 wherein continued rotation of the child lock sector from its second sector position to its first sector position causes the child lock sector to drive the double pull sector from its double lock OFF position to its double lock ON position which causes corresponding movement of the double pull lever to its double pull-ON position with the link lever located in its disengaged position.

12. The closure latch of claim 1 wherein a first pull of the inside door handle causes movement of the inside release lever to its actuated condition with the link lever in its disengaged position such that the auxiliary release lever is maintained in its home position, wherein movement of the inside release lever to its actuated position causes the double pull sector to move to its double lock OFF position, wherein upon return of the inside release lever to its home position upon completion of the first pull the double pull lever moves to its double pull-OFF position and the link lever moves to its engaged position, and wherein a subsequent second pull of the inside door handle causes the inside release lever to move to its actuated position which drives the auxiliary release lever to its actuator lever release position for providing a double pull inside release function.

13. A closure latch for a vehicle door, comprising:

a latch mechanism including a ratchet and a pawl, the ratchet being moveable between a striker capture position and a striker release position, the pawl being moveable between a ratchet holding position whereat the pawl holds the ratchet in its striker capture position and a ratchet releasing position whereat the pawl permits the ratchet to move to its striker release position;

a power release mechanism having an actuator lever operatively connected to the pawl and a power release actuator, the actuator lever being moveable between a non-actuated position whereat the pawl is maintained in its ratchet holding position and an actuated position whereat the actuator lever moves the pawl to its ratchet releasing position, the power release actuator being operable to move the actuator lever from its non-actuated position to its actuated position;

an inside release mechanism including an inside release lever, an auxiliary release lever and a link lever, the inside release lever being configured to be coupled to an inside door handle and being moveable between a home position and an actuated position in response to actuation of the inside door handle, the auxiliary release lever being moveable between a home position whereat the actuator lever is maintained in its non-actuated position and an actuator lever release position whereat the auxiliary release lever moves the actuator lever to its actuated position, the link lever being moveable between a disengaged position whereat the inside release lever is disconnected from the auxiliary release lever and an engaged position whereat the link lever operatively couples the inside release lever to the auxiliary release lever such that movement of the inside release lever between its home and actuated positions results in concurrent movement of the auxiliary release lever between its home and actuator lever release positions;

a double pull actuation mechanism including a double pull lever and a double pull sector, the double pull lever being operatively coupled to the link lever and being moveable between a double pull-ON position whereat the double pull lever holds the link lever in its disengaged position and a double pull-OFF position whereat the double pull lever moves the link lever to its engaged position, the double pull sector being moveable relative to the double pull lever between a double lock ON position whereat the double pull sector holds the double pull lever in its double pull-ON position and a double lock OFF position whereat the double pull sector permits the double pull lever to move relative to the double pull sector to its double pull-OFF position, wherein movement of the inside release lever from its home position to its actuated position causes movement of the double pull sector from its double lock ON position to its double lock OFF position; and a power child lock mechanism having a child lock sector and a power lock actuator, the child lock sector being moveable between a first sector position whereat the child lock sector holds the double pull sector in its double lock ON position, a second sector position whereat the double pull sector is located in its double lock OFF position, and a third sector position whereat the child lock sector holds the double pull lever in its double pull-ON position.

14. The closure latch of claim 13 wherein the inside release lever includes a guide slot, wherein the link lever includes a guide post disposed in the guide slot for movement of the link lever between its disengaged and engaged positions relative to the inside release lever, and wherein the auxiliary release lever includes a bypass cavity and a drive lug such that the guide post is aligned with the bypass cavity when the link lever is located in its disengaged position and the guide post is aligned with the drive lug when the link lever is located in its engaged position.

15. The closure latch of claim 14 wherein the double pull lever includes a drive slot through which the guide post extends and which is configured to locate the link lever in its disengaged position when the double pull lever is located in its double pull-ON position and to locate the link lever in its engaged position when the double pull lever is located in its double pull-OFF position.

* * * * *